US006840832B2

(12) United States Patent
Suzuki et al.

(10) Patent No.: US 6,840,832 B2
(45) Date of Patent: Jan. 11, 2005

(54) IMAGE DISPLAY APPARATUS AND METHOD OF MANUFACTURING THE SAME

(75) Inventors: Norihiro Suzuki, Kanagawa (JP); Yoichi Ando, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 09/892,641

(22) Filed: Jun. 28, 2001

(65) Prior Publication Data

US 2002/0017856 A1 Feb. 14, 2002

(30) Foreign Application Priority Data

Jun. 30, 2000 (JP) ..... 2000-197979
Jun. 19, 2001 (JP) ..... 2001-185455

(51) Int. Cl.[7] ..... H01J 9/00; H01J 9/38

(52) U.S. Cl. ..... 445/5; 445/6; 445/24; 445/61; 445/2

(58) Field of Search ..... 445/59, 6, 24, 445/58

(56) References Cited

U.S. PATENT DOCUMENTS

| | | | | |
|---|---|---|---|---|
| 4,416,642 A | * | 11/1983 | VanOrmer | 445/11 |
| 4,605,379 A | * | 8/1986 | Shahan | 445/59 |
| 4,662,853 A | * | 5/1987 | Van Veldhoven | 315/368.27 |
| 4,769,575 A | * | 9/1988 | Murata et al. | 313/495 |
| 4,904,895 A | | 2/1990 | Tsukamoto et al. | 313/336 |
| 4,992,067 A | * | 2/1991 | Fiock | 445/30 |
| 5,066,883 A | | 11/1991 | Yoshioka et al. | 313/309 |

(List continued on next page.)

FOREIGN PATENT DOCUMENTS

| | | |
|---|---|---|
| JP | 64-31332 | 2/1989 |
| JP | 2-257551 | 10/1990 |
| JP | 3-55738 | 3/1991 |
| JP | 4-28137 | 1/1992 |
| JP | 7-105847 | 4/1995 |
| JP | 7-105850 | 4/1995 |

OTHER PUBLICATIONS

M. Hartwell, et al., "Strong Electron Emission From Patterned Tin–Indium Oxide Thin Films", International Electron Devices Meeting, Technical Digest, pp. 519–521 (1975).

H. Araki, et al., "Electroforming and Electron Emission of Carbon Thin Films", Journal of the Vacuum Society of Japan, vol. 26, No. 1, pp. 22–29 (1983).

C.A. Spindt, et al., "Physical Properties of Thin–Film Emission Cathodes with Molybdenum Cones", Journal of Applied Physics, vol. 47, No. 12, p. 5248–5263 (Dec. 1976).

(List continued on next page.)

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

An image display apparatus is provided, in which the generation of discharge can be suppressed and a preferable display image can be obtained. A method of manufacturing an image display apparatus having an airtight container including a rear plate having a plurality of electron-emitting devices and a face plate which is located opposite to the rear plate and has a phosphor and an electroconductive film, includes the steps of, (A) disposing the rear plate having the plurality of electron-emitting devices and the face plate having the phosphor and the electroconductive film such that the rear plate and the face plate are opposite to each other and arranging a plurality of plate shaped spacers between the rear plate and the face plate to assemble the airtight container, and (B) applying an electric field between the rear plate and the face plate in a state that the airtight container is slanted such that a longitudinal direction of the plate-shaped spacers is not perpendicular to a gravitational direction.

3 Claims, 19 Drawing Sheets

U.S. PATENT DOCUMENTS

| | | | | | |
|---|---|---|---|---|---|
| 5,312,280 | A | * | 5/1994 | Kloba et al. | 445/59 |
| 5,569,974 | A | | 10/1996 | Morikawa et al. | 313/310 |
| 5,595,520 | A | * | 1/1997 | Piascinski et al. | 445/59 |
| 5,682,085 | A | | 10/1997 | Suzuki et al. | 315/169.1 |
| 5,719,466 | A | * | 2/1998 | Tsai | 313/495 |
| 6,169,356 | B1 | | 1/2001 | Ohnishi et al. | 313/495 |
| 6,236,159 | B1 | * | 5/2001 | Inoue et al. | 313/582 |
| 6,246,168 | B1 | | 6/2001 | Kishi et al. | 313/495 |

OTHER PUBLICATIONS

C.A. Mead, "Operation of Tunnell–Emission Devices", Journal of Applied Physics, vol. 32, No. 4, pp. 646–652 (Apr. 1961).

R. Meyer, "Recent Development on "Microtips" Display at LETI", Technical Digest of IVMC, pp. 6–9 (1991).

M.I. Elinson, et al., "The Emission of Hot Electrons and the Field Emission of Electrons From Tin Oxide", Radio Engineering and Electronic Physics, No. 10, pp. 1290–1296 (Jul. 1965).

W.P. Dyke, et al., "Field Emission", Advances in Electronics and Electron Physics, vol. VIII, pp. 89–185 (1956).

G. Dittmer, "Electrical Conduction and Electron Emission of Discontinuous Thin Films", Thin Solid Films, 9, pp. 317–328 (1972).

* cited by examiner

IMAGE DISPLAY APPARATUS AND METHOD OF MANUFACTURING THE SAME

BACKGROUND OF THE INVENTION

1. Field of the Invention

The present invention relates to an image display apparatus such as an electron beam emitting device or a display device and its application and a method of manufacturing the image display apparatus.

2. Related Background Art

Conventionally, two types of electron-emitting devices, that is, a thermionic cathode electron emitting device and a cold cathode electron emitting device, are known as the electron-emitting device. Of these devices, as the cold cathode electron-emitting device, for example, a surface conduction type electron emitting device, a field emission type (hereinafter referred to as an FE type), a metal/insulating-layer/metal type (hereinafter referred to as an MIM type), and the like are known.

As the surface conduction type electron emitting device, the example described in M. I. Elinson, Radio Eng. Electron Phys., 10, 1290 (1965) and another example described later are known.

The surface conduction type electron emitting device is realized by utilizing the phenomenon that electrons are emitted out of a small area thin film formed on a substrate when a current is made to flow in parallel with respect to the film surface. As the surface conduction type electron emitting device, in addition to the device using an $SnO_2$ thin film by above-mentioned Elinson et al., a device using an Au thin film (G. Dittmer: "Thin Solid Films", 9, 317 (1972)), a device using an $In_2O_3/SnO_2$ thin film (M. Hartwell and C. G. Fonstad: "IEEE Trans. ED Conf.", 519 (1975)), a device using a carbon thin film (H. Araki et al.: Vacuum, Vol. 26, No. 1, 22 (1983)), and the like, have been reported.

As a typical example of a device structure of these surface conduction type electron emitting devices, a plan view of the above device by M. Hartwell and C. G. Fonstad is shown in FIG. 19. In this drawing, reference numeral 3001 denotes a substrate and 3004 denotes an electroconductive thin film which is made of metal oxide and formed by sputtering. The electroconductive thin film 3004 is formed into an H-shaped plane form as shown in the drawing. An energization operation and called an energization forming which is described later is performed for the electroconductive thin film 3004 to form an electron emitting region 3005. In the drawing, an interval L is set to be 0.5 mm to 1 mm and W is set to be 0.1 mm. Note that, for the convenience of illustrating, the electron emitting region 3005 is shown with a rectangular form in the center of the electroconductive film 3004. However, this is a schematic view and does not precisely show the position and the form of the actual electron emitting region.

In the above surface conduction type electron emitting device such as the device by M. Hartwell and C. G. Fonstad, generally, before electron emitting, an energization operation which is called an energization forming is performed for the electroconductive thin film 3004 to form the electron emitting region 3005. That is, in the energization forming, a constant direct current voltage or a direct current voltage increased at an extremely slow rate such as about 1 V/minute is applied to both ends of the electroconductive thin film 3004 to make the energization. Thus, the electroconductive thin film 3004 is locally broken, deformed, or deteriorated to form the electron emitting region 3005 with an electrically high resistance state. Note that, a fissure is generated in a portion of the electroconductive thin film 3004 which is locally broken, deformed, or deteriorated. When a suitable voltage is applied to the electroconductive thin film 3004 after the energization forming, the electrons are emitted at the vicinity of the fissure.

Also, as the FE type, the examples disclosed in W. P. Dyke & W. W. Dolan, "Field Emission", Advance in Electron Physics, 8, 89 (1956), C. A. Spindt, "Physical Properties of Thin-film Field Emission Cathodes with Molybdenum Cones", J. Appl. Phys., 47, 5248 (1976), and the like are known.

As a typical example of a device structure of the FE type, a cross sectional view of the above device by C. A. Spindt et al. is shown in FIG. 20. In the drawing, reference numeral 3010 denotes a substrate, 3011 denotes an emitter wiring made of an electroconductive material, 3012 denotes an emitter cone, 3013 denotes an insulating layer, and 3014 denotes a gate electrode. This device causes, by applying a suitable voltage between the emitter cone 3012 and the gate electrode 3014, the field emission from the end portions of the emitter cone 3012.

Also, as another device structure of the FE type, there is an example in that an emitter and a gate electrode are located on a substrate substantially parallel with a surface of the substrate without using a lamination structure as shown in FIG. 20.

As the MIM type, the examples described in C. A. Mead, "Operation of Tunnel-Emission Devices", J. Appl. Phys., 32, 646 (1961), and the like are known. A typical example of a device structure of the MIM type is shown in FIG. 21. This drawing is a cross sectional view. In the drawing, reference numeral 3020 denotes a substrate, 3021 denotes a lower electrode made of metal, 3022 denotes a thin insulating layer having a thickness of about 100 angstroms, and 3023 denotes an upper electrode which has a thickness of about 80 to 300 angstroms and made of metal. In the MIM type, a suitable voltage is applied between the upper electrode 3023 and the lower electrode 3021, and thus the electron emitting from the surface of the upper electrode 3023 is produced.

In the above cold cathode electron-emitting device, since the electron-emitting can be obtained at lower temperature than in the thermionic cathode electron-emitting device, a heater is not required. Therefore, the structure of the cold cathode electron-emitting device is simpler than that of the thermionic cathode electron-emitting device, and thus a minute device can be manufactured. Even when a large number of devices are arranged in a high density on the substrate, it prevents the problem such as thermal melting of the substrate to cause. Also, while a response speed of the thermionic cathode electron-emitting device is low because it is operated by heating of the heater, there is an advantage that a response speed is high in the case of the cold cathode electron-emitting device.

Therefore, studies for applying the cold cathode electron-emitting device have been greatly performed. Of the cold cathode electron-emitting devices, for example, the surface conduction type emitting device, in particular, has a simple structure and is easily manufactured. Thus, there is an advantage that a large number of devices can be formed over a large area. As disclosed in, for example, Japanese Patent Application Laid-Open NO. 64-31332 by the present applicant, a method of arranging a large number of devices and driving them has been studied.

As an application of the surface conduction type emitting device, an image display apparatus, an image display apparatus used in an image recording apparatus, a charged beam source, and the like have been studied.

In particular, as an application to the image display apparatus, as disclosed in, for example, U.S. Pat. No. 5,066,883 and Japanese Patent Application Laid-Open Nos. 2-257551 and 4-28137 by the present applicant, an image display apparatus using a combination of the surface conduction type emitting device and a phosphor for emitting light by an irradiation of an electron beam has been studied. With respect to the image display apparatus using a combination of the surface conduction type electron emitting device and the phosphor, a characteristic superior to that of a conventional image display apparatus with another system is expected. For example, when it is compared with a liquid crystal display device which comes to be widely used in recent years, there are advantages in that a backlight unit is not required because it is a self light emitting type, and in that a viewing angle is wide.

A method of arranging a large number of FE type devices and driving them is disclosed in, for example, U.S. Pat. No. 4,904,895 by the present applicant. Also, as an example that the FE type is applied to the image display apparatus, for example, a flat panel display reported by R. Meyer et al. is known (R. Meyer: "Recent Development on Micro-tips Display at LETI", Tech. Digest of 4th Int. Vacuum Microelectronics Conf., Nagahama, pp. 6–9 (1991)).

An example that a large number of MIM type devices to be arranged are applied to the image display apparatus is disclosed in, for example, Japanese Patent Application Laid-Open No. 3-55738 by the present applicant.

Of the image display apparatuses using the above electron-emitting device, the flat panel display which is thin in a depth dimension is space-saving and lightweight. Thus, this is noted as a display which replaces a cathode-ray tube type display.

FIG. 22 is a perspective view of a portion of a display panel portion composing the flat panel display using a cold cathode electron-emitting device. In FIG. 22, in order to show an inner structure, a portion of the panel is cut.

In the drawing, reference numeral 3115 denotes a rear plate, 3116 denotes a side wall, and 3117 denotes a face plate. An envelope (airtight container) for keeping the inner portion of the display panel in a vacuum state is formed by the rear plate 3115, the side wall 3116, and the face plate 3117.

A substrate 3111 is fixed to the rear plate 3115. An N×M of electron-emitting devices 3112 are formed on the substrate 3111. Symbols N and M are positive integers which are equal to or larger than two and suitably set in accordance with the number of display pixels to be required. As shown in FIG. 22, the N×M of electron-emitting devices 3112 are wired using M-row-directional wirings 3113 and N-column-directional wirings 3114. A portion composed of the substrate 3111, the electron-emitting devices 3112, the row-directional wirings 3113, and the column-directional wirings 3114 is called a multi-electron beam source. In portions where the row-directional wirings 3113 and the column-directional wirings 3114 are at least intersected, insulating layers (not shown) are formed between both the wirings to keep the electrical insulation.

A fluorescent film 3118 made of phosphors is formed on an undersurface of the face plate 3117. The phosphors with three primary colors (red (R), green (G), and blue (B)) (not shown) are applied to the fluorescent film 3118. Also, black color members (not shown) are provided between the phosphors with the above respective colors, which composes the fluorescent film 3118. Further, a metalback 3119 made of Al or the like is formed on a surface of the fluorescent film 3118, which is in the side of the rear plate 3115.

Reference symbols Dx1 to Dxm, Dy1 to Dyn, and Hv denote electrical connecting terminals with an airtight structure, which are provided to electrically connect the display panel to electrical circuits (not shown). The terminals Dx1 to Dxm are electrically connected to the row-directional wirings 3113 of the multi-electron beam source, the terminals Dy1 to Dyn are electrically connected to the column-directional wirings 3114 of the multi-electron beam source, and the terminal Hv is electrically connected to the metalback 3119.

The inner portion of the above airtight container is kept in a vacuum of about $10^{-6}$ Torr. As the display area of the image display apparatus is increased, means for preventing deformation or break of the rear plate 3115 and the face plate 3117 due to an atmospheric pressure difference between the inner portion of the airtight container and its external is required. In the case of a method for thickening the rear plate 3115 and the face plate 3117, the weight of the image display apparatus is increased, and the distortion or the parallax of an image is caused when it is viewed from an oblique direction. On the other hand, in FIG. 22, structure supports (which are called spacers or ribs) 3120 which are made from a relatively thin glass plate and keep an atmospheric pressure, are provided. Thus, an interval between the substrate 3111, on which the multi-electron beam source is formed, and the face plate 3117, on which the fluorescent film 3118 is formed, is kept by generally submillimeters to several millimeters. As described above, the inner portion of the airtight container is kept in a high vacuum.

According to the above described image display apparatus using the display panel, when voltages are applied to the respective cold cathode electron-emitting devices 3112 through the container external terminals Dx1 to Dxm and Dy1 to Dyn, electrons are emitted from the respective cold cathode electron-emitting devices 3112. Simultaneously, a high voltage of several hundreds volts to several kilovolts is applied to the metalback 3119 through the container external terminal Hv to accelerate the emitted electrons. Thus, the electrons are collided with the inner surface of the face plate 3117. As a result, the phosphors with respective colors, composing the fluorescent film 3118, are excited to emit lights, and then the image is displayed.

SUMMARY OF THE INVENTION

In the display panel of the above mentioned conventional image display apparatus, there are following problems.

As described above, in order to accelerate electrons emitted from the cold cathode electron-emitting devices 3112, a high voltage of several hundreds volts or higher (that is, a high electric field of 1 kV/mm or higher) is applied between the multi-beam electron source and the face plate 3117.

Therefore, vacuum discharge is generated in a space between the face plate 3117 and the substrate 3111, which includes the electron-emitting devices 3112, the row-directional wirings 3113, and the column-directional wirings 3114.

It is considered that the vacuum discharge is caused by the projection, the adhesion of dust, the absorption of gas, or the like on the substrate 3111 and the face plate 3117. The discharge is suddenly generated during image displaying. Thus, there is a problem that the image is disturbed and the electron-emitting devices 3112 located in the vicinity of the discharge portion are greatly deteriorated, and thus the display after that cannot be normally made. Also, if dust is adhered onto the face plate, the electrons emitted from the electron-emitting devices 3112 toward the face plate 3117 are blocked. As a result, there is a case where a pixel defect is produced in the display image. Thus, a solving method effective against foreign matter entered into the airtight container and matter fallen from constitution members in an assembly stage is desired.

The present invention is made to solve such problems, and therefore an object of the present invention is to provide a method of manufacturing an image display apparatus in which the generation of discharge at the time of image display can be prevented to obtain a preferable display image and an image display apparatus manufactured by this manufacturing method.

The present invention is a method of manufacturing an image display apparatus having an airtight container including a rear plate having a plurality of electron-emitting devices, and a face plate which is located opposite to the rear plate and has a phosphor and an electroconductive film, characterized by comprising the steps of: (A) disposing the rear plate having the plurality of electron-emitting devices and the face plate having the phosphor and the electroconductive film such that the rear plate and the face plate are opposite to each other and arranging a plurality of plate shaped spacers between the rear plate and the face plate to assemble the airtight container; and (B) applying an electric field between the rear plate and the face plate in a state that the airtight container is slanted such that a longitudinal direction of the plane shaped spacers is not in vertical to a gravitational direction.

Also, the present invention is a method of manufacturing an image display apparatus, in which a rear plate and a face plate are opposite to each other to form an airtight container, an electron beam source is formed in the rear plate, a phosphor is formed in the face plate, and a high voltage is applied between the rear plate and the face plate to irradiate the electron beam into the phosphor in order to emit light from the phosphor, characterized by comprising: a foreign matter removing step of removing a foreign matter entered into the airtight container from a region to which the high voltage is applied.

DETAILED DESCRIPTION OF THE PREFERRED EMBODIMENTS (First Embodiment)

Figure 1:
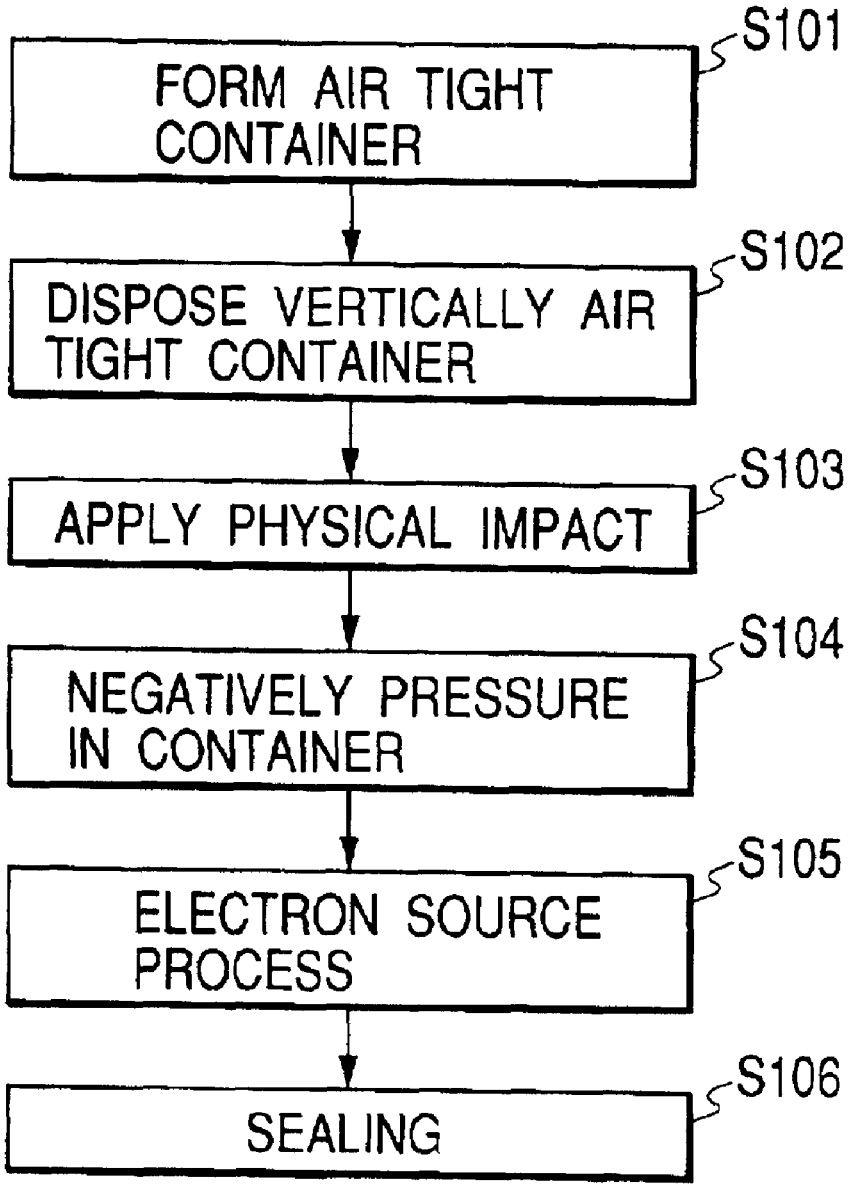
FIG. 1 is a flow chart showing steps of a method of manufacturing an image display apparatus.

Hereinafter, an image display apparatus of the present invention will be described in details. First, based on a first embodiment of the present invention, a process flow of a method of manufacturing the image display apparatus in the present invention will be simply described using FIG. 1.

First, an airtight container constructed by a rear plate 1015 before "a forming process" which is described below, a side wall 102, a face plate 101 including phosphors, spacers 103 for an atmospheric pressure resisting structure, and the like, is assembled (Step S101). An assembly method, structures of respective members, and the like, will be described later in detail.

Figure 2:
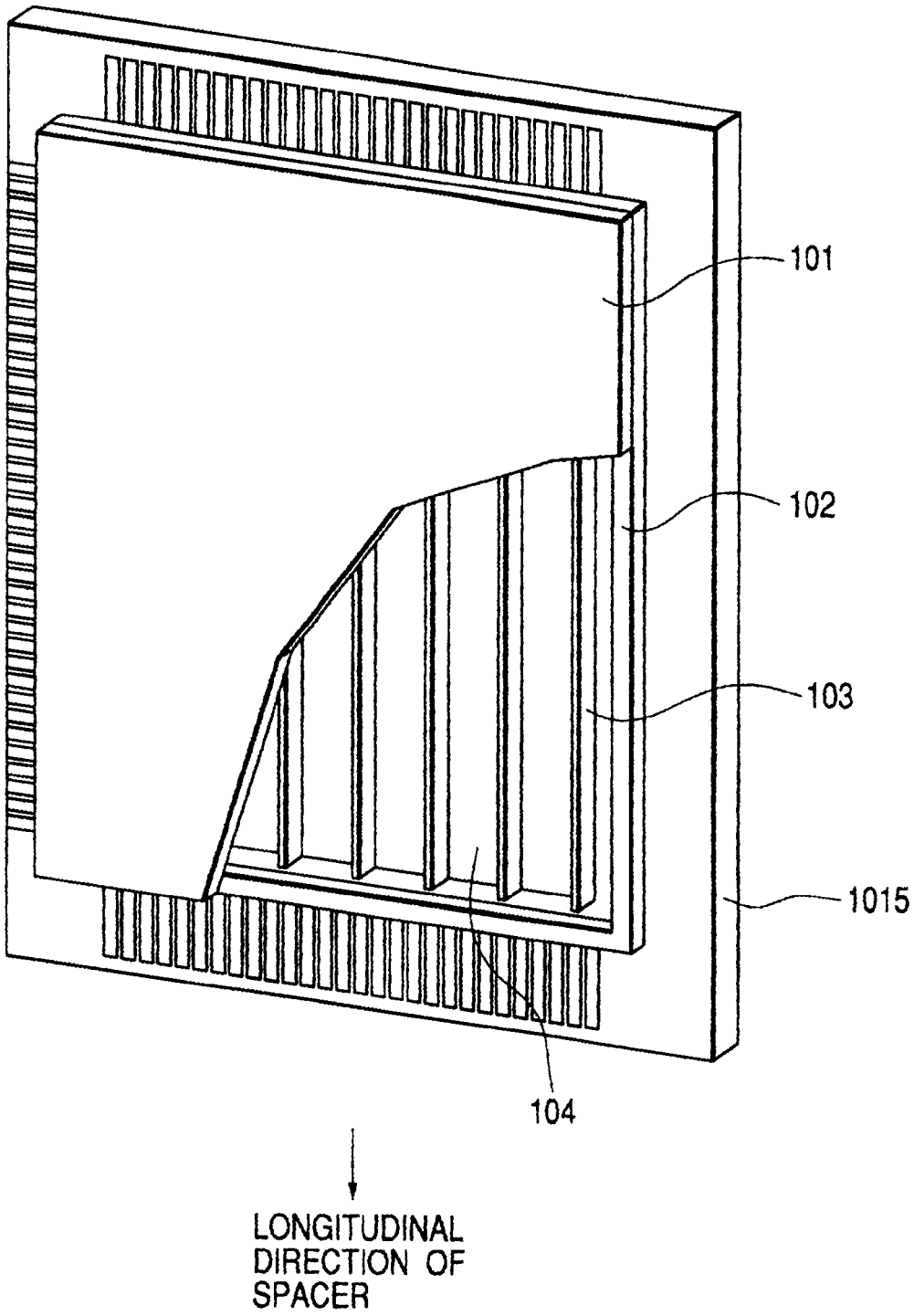
FIG. 2 is a perspective view showing a state that a portion of a display panel of the image display apparatus is cut.

Next, as shown in FIG. 2, in order to set the arrangement (longitudinal direction) of the above spacers 103 to be in a vertical direction (which is in substantially parallel with the gravitational direction), the airtight container is slanted and disposed (Step S102).

Next, a foreign matter removing process characterized by the present invention is performed (Step S103). The foreign matter removing process roughly includes the following two processes, that is, a first process for floating a foreign matter over an adherent surface and a second process for moving the floated foreign matter outside an image region. The foreign matter removing method will be described later in detail.

Subsequently, vacuuming is performed until an inner pressure of the airtight container reaches approximately $1\times10^{-4}$ Pa (Step S104).

Then, an electron source forming process required for forming the surface conduction type electron-emitting device is performed (Step S105). Concretely, this includes "a forming process" and "an activating process" for forming an electron emitting region. These processes will also be described later in detail. Note that "the forming process" and "the activating process" are performed through a row-directional wirings 1013 and a column-directional wirings 1014, which are described later.

Finally, an exhaust pipe connected to the airtight container is closed to form a display panel (Step S106).

There are the following two points as objects of the process for removing the foreign matter in the airtight container, which is characterized by the present invention.

A first object is that, in a stage before a high voltage is applied between the face plate and the rear plate in the airtight container (the image display apparatus is driven), the foreign matter as one of the discharge factors at the time of application of the high voltage is moved outside an image display region to which an electric field of relatively weak intensity is applied at the time of driving the image display apparatus. Thus, the generation of discharge between the face plate and the rear plate is suppressed. In a conventional manufacturing method, the foreign matter entered into the airtight container is left therein, and then a high voltage is applied between the face plate and the rear plate. Therefore, since a high electric field is concentrated on the foreign matter, the discharge from the foreign matter as a starting point is easy to generate. As a result, if the discharge is generated, the electron-emitting devices on the rear plate, the phosphors on the face plate, and the like are damaged, and thus causes the deterioration in the display quality of the image display apparatus.

A second object is that, even if the discharge is not generated by the foreign matter which is present in the image display region, the occurrence of a pixel defect (display defect) generated by blocking electrons emitted from the electron source is prevented. Thus, the quality of the display image can be improved.

According to the present invention, the foreign matter which is present in the image display region can be moved outside the image display region on which the influence of the electric field is small at the time of driving of the image display apparatus. Thus, the generation of discharge in the image display apparatus can be suppressed. Also, the image that has high quality without a pixel defect due to the foreign matter can be provided.

As described above, a maximum characteristic of the present invention is to perform a process for moving the foreign matter entered into the image display region in the airtight container to a region in which no influence is exerted.

Figure 3:
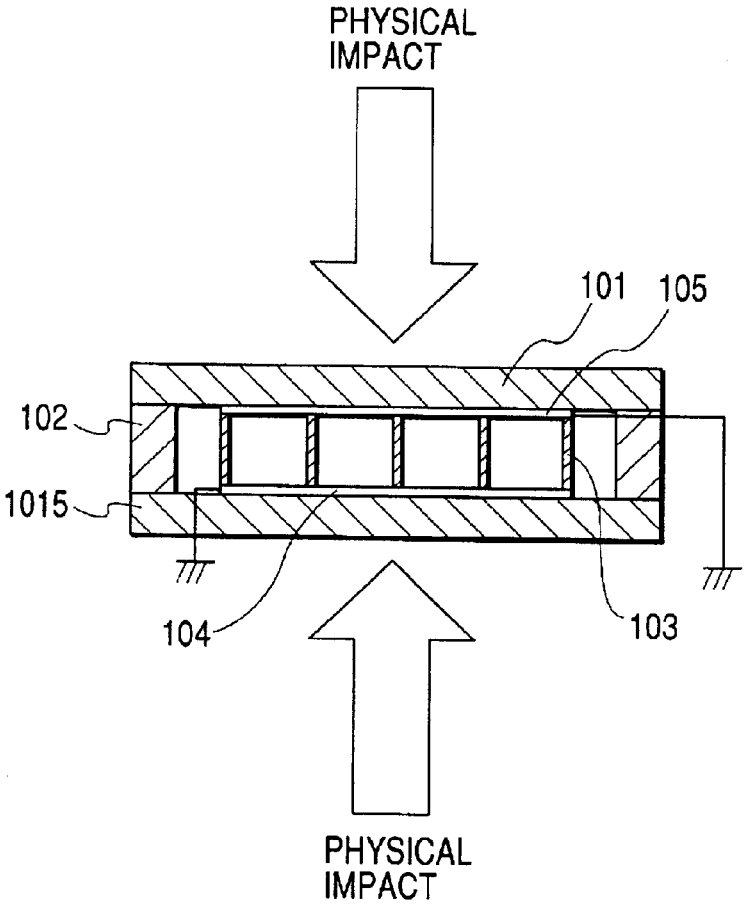
FIG. 3 is a cross sectional view of an airtight container for implementing the method of manufacturing the image display apparatus.

Next, the foreign matter removing process characterized by the present invention will be described below using one example. A schematic structure of one example described here is shown in FIGS. 2 and 3. First, the rear plate 1015, the face plate 101, a frame (side wall) 102 for keeping a gap between the face plate 101 and the rear plate 1015, and the spacers 103 for keeping the gap are assembled. Next, as shown in FIG. 2, the airtight container is stood (slanted) such that the arrangement (longitudinal direction) of the spacers 103 is set to be in a vertical direction (which is in substantially parallel with the gravitational direction).

An object for slanting the airtight container is to move the entered foreign matter outside the image display region by falling due to its own weight using the gravitation. Here, the airtight container is vertically stood (the longitudinal direction of the spacers is set to be in parallel with the gravitational direction). It is ideal that a stand angle of the airtight container is set as 90 degrees. Note that this angle is the one in the case where the greatest influence is exerted by the gravitation. However, when the airtight container is slightly slanted (when the longitudinal direction of the spacers is set not to be in vertical to the gravitational direction), the foreign matter removing effect is obtained. Here, the foreign matter removing process is performed in a state that the inner pressure of the airtight container is in an atmospheric pressure state. However, as another example described later, this process can be performed in a state that the airtight container is under depressurized condition. Also, this process can be performed after the airtight container is sealed.

Next, as a process for floating the foreign matter, in this embodiment, the physical impact is applied to the surface of the face plate 101 or to the surface of the rear plate 1015 in the airtight container.

A strength of the impact and a point to which the impact is applied are determined such that the impact of 50 G to 1000 G is applied over the entire surface of the image display region in the airtight container. The impact may be applied to plural points. Also, the impact may be applied to both the face plate and the rear plate. The physical impact may be simultaneously applied to plural points or in succession, in the case where it is applied to plural points. In the case of the application to the respective points, when the airtight container is slanted, it is desirable that the impact is applied from the upper side portion of the airtight container. Also, when a series of these processes is performed, a fluorescent film 105 located on the face plate and electron-emitting device regions 104 located on the rear plate are grounded to remove static electricity. Thus, a state that the foreign matter is easy to float is obtained.

In this embodiment, the impact is applied to plural points of the airtight container such that the impact of 100 G or higher is applied to all points within the image non-display region. A point different from a second embodiment described later is a pressure state, that is, whether it is an atmospheric pressure state or in a negative pressure state (depressurized state) in the airtight container. In the embodiment described here, it is in an atmospheric pressure state and thus a process for negatively pressurizing the airtight container is not required. Therefore, it is advantageous in view of a low cost.

This process is performed to remove the floated and moved foreign matter outside the image display region in the lower portion of the panel in the slant direction. In order to prevent the return of the moved foreign matter into the image display region, it is desirable that a foreign matter pooling structure is formed in the airtight container or a structure capable of exhausting the foreign matter outside the airtight container is formed.

In the image forming apparatus manufactured through such processes, the generation probability of discharge between the face plate and the rear plate is reduced and a preferable image with no defect due to the foreign matter can be obtained.

Also, the image forming apparatus manufactured by this foreign matter removing process is disassembled and then the existence states of the foreign matter inside and outside the image display region are checked. This check is performed using an optical microscope. A size of the foreign matter to be checked is 1 $\mu$m or more. As a result, the existence number of the foreign matters outside the image display region is larger than that inside the image display region.

According to results by the inventor's concentrated study, in a conventional image forming apparatus manufactured without the foreign matter removing process, a large number of foreign matters tend to exist in the image display region. It is cleared from results of an SEM analysis and an EDX spectral analysis that a generation source of the foreign matter is mainly contamination by a process, foreign matter on wirings on the rear plate, or fallen matter from the fluorescent film (phosphor or metalback). Thus, there are many foreign matter generation factors in the image display region. When this foreign matter removing process is performed, the foreign matter inside the image display region can be moved outside the image display region. The foreign matter present in the image display region is moved to the lower side portion of the slanted airtight container, by the foreign matter removing process of the present invention.

Next, one example of a structure of a display panel in the image display apparatus of the present invention and a manufacturing method excluding the above foreign matter removing process will be described by indicating a concrete example.

(1) Summary of the Image Display Apparatus

Figure 6:
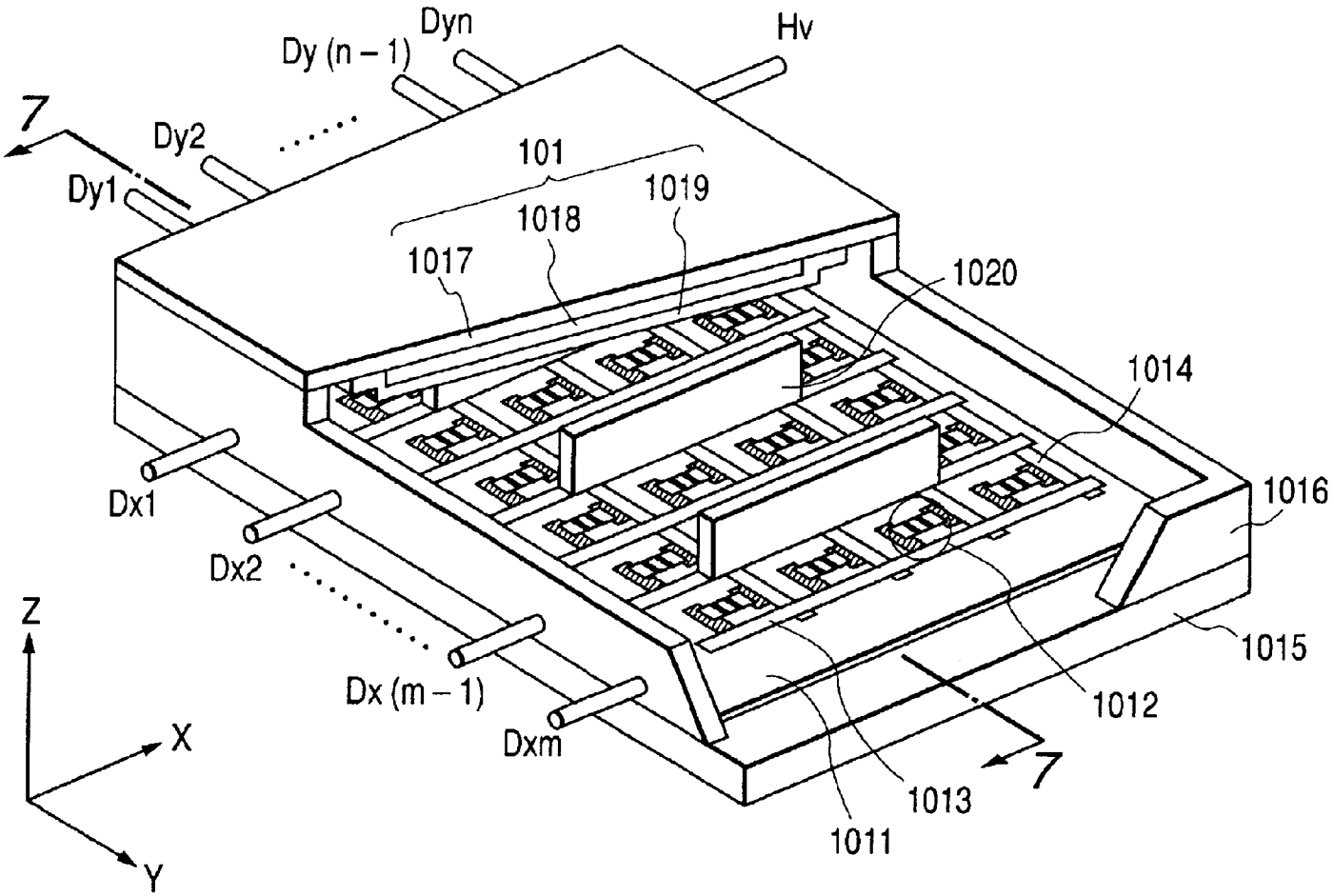
FIG. 6 is a perspective view showing a state that a portion of the display panel of the image display apparatus is cut.
Figure 7:
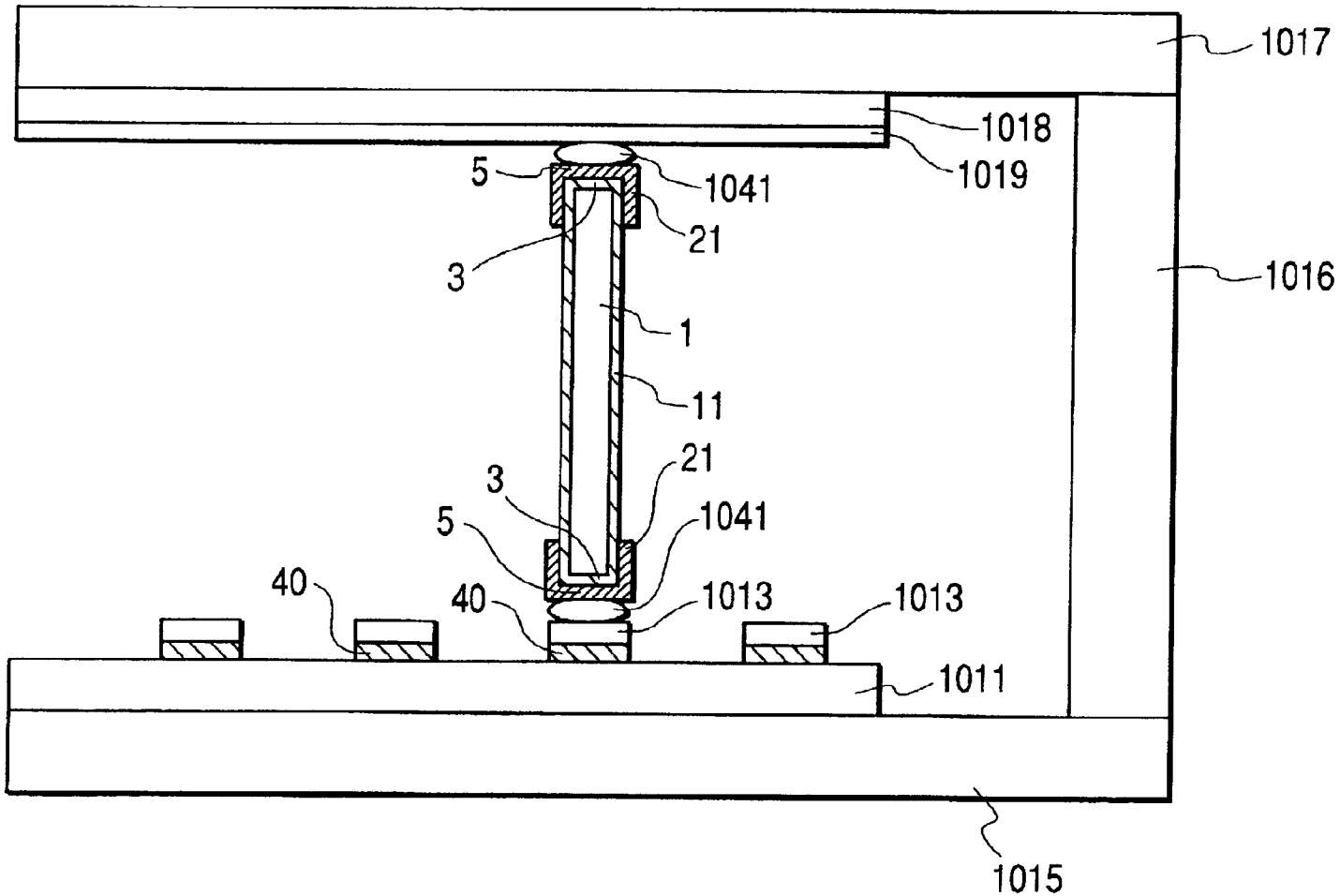
FIG. 7 is a schematic cross sectional view showing a cross section taken along a dashed line A–A' in FIG. 6.

FIG. 6 is a perspective view of the display panel and a portion of the display panel is cut to show the inner structure.

In the drawing, reference numeral 1015 denotes a rear plate, 1016 denotes a side wall, and 101 denotes a face plate. An airtight container for keeping the inner portion of the display panel in a vacuum is formed by the rear plate 1015, the side wall 1016, and the face plate 101. When the airtight container is assembled (airtight container formation), it is necessary to seal-bond (adhere) joint portions of respective members to each other. For example, frit glass is applied to respective joint portions and then firing is made in an atmosphere or in a nitrogen atmosphere at 400 to 500 degrees Celsius for ten minutes or longer. Thus, the seal bonding can be realized. A method of vacuum-exhausting the inner portion of the airtight container will be described later. The inner portion of the above airtight container is kept in a vacuum of about $10^{-4}$ Pa. Therefore, in order to prevent a break of the airtight container due to an atmospheric pressure, sudden impact, or the like, spacers 1020 are provided as atmospheric pressure resisting structures.

The face plate 101 is constructed by a transparent substrate 1017, a fluorescent film 1018 located on the surface of the transparent substrate 1017, and a metalback (electroconductive film) 1019. The rear plate 1015 has an electron source substrate 1011 on its surface. Note that, here, the electron source substrate 1011 and the rear plate 1015 are used as separate members. However, there is the case where the rear plate is constructed by only the electron source substrate 1011. Row-directional wirings 1013 and column-directional wirings 1014 are connected with respective electron-emitting devices 1012 in order to drive them.

It is required that the spacers 1020 have the insulation capable of resisting a high voltage applied between the row-directional wirings 1013 and the column-directional wirings 1014 on the electron source substrate 1011 and the metalback (electroconductive film) 1019 on the inner surface of the transparent substrate 1017. Also, preferably, in order to suppress the charge of the surfaces of the spacers 1020, electroconductive films are provided on these surfaces.

In the configuration described here, the spacers 1020 have a plate shape and are arranged such as the longitudinal direction thereof is in parallel with the row-directional wirings 1013. The spacers are formed as follows. For example, frit glass is applied to joint portions and then firing is made in an atmosphere or in a nitrogen atmosphere at 400 to 500 degrees Celsius for ten minutes or longer. The formed spacers are fixed onto the face plate 1017 and/or the electron source substrate 1011.

An N×M of cold cathode electron-emitting devices 1012 are formed on the electron source substrate 1011. Symbols N and M are positive integers which are equal to or larger than two and suitably set in accordance with the number of display pixels to be required. For example, in the image forming apparatus for a high quality television display, it is desirable to set that N=3000 or more and M=1000 or more. The N×M of electron-emitting devices are matrix-wired using M-row-directional wirings 1013 and N-column-directional wirings 1014. A portion composed of the electron source substrate 1011, the electron-emitting devices 1012, the row-directional wirings 1013, and the column-directional wirings 1014 is called a multi-electron beam source.

Next, a structure of the multi-electron beam source in which surface conduction type electron-emitting devices (described later) as the electron-emitting devices are arranged on a substrate and matrix-wired will be described.

Figure 10A:
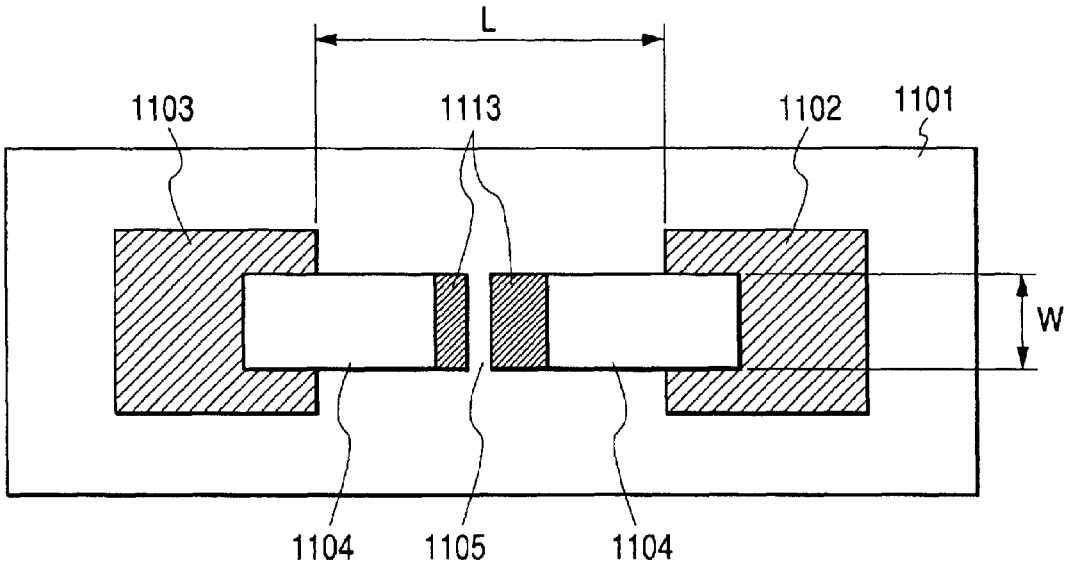
FIGS. 10A and 10B are schematic views showing a plan structure and a cross section structure of a surface conduction type emitting device of a plane type.
Figure 10B:
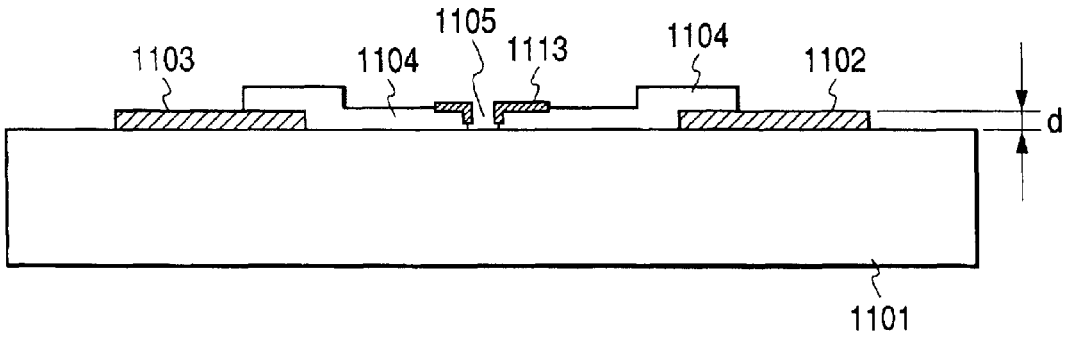
Figure 17:
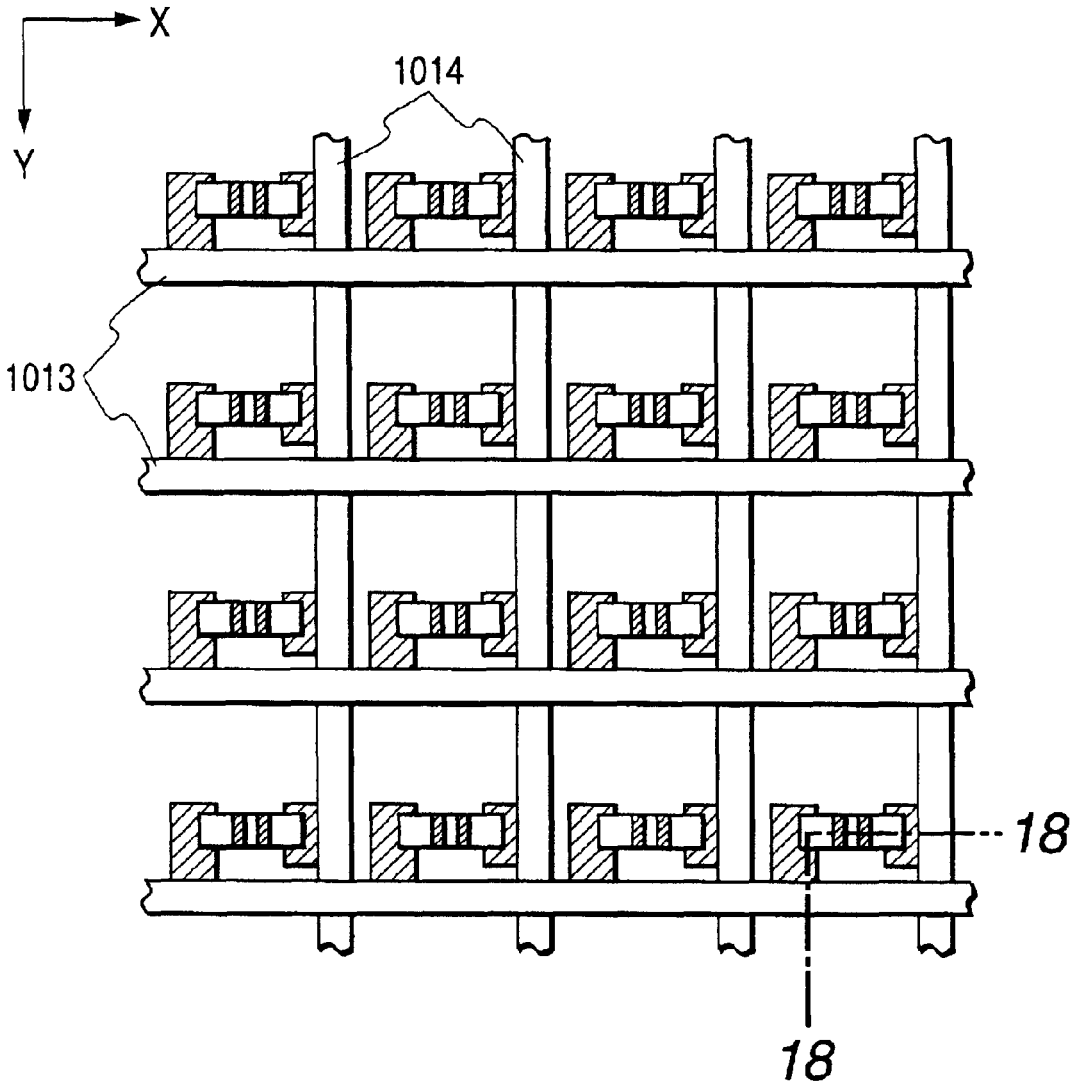
FIG. 17 is a plan view of a substrate of a multi-electron beam source.

FIG. 17 is a plan view of the multi-electron beam source used for the display panel of FIG. 6. The surface conduction type electron-emitting devices similar to structures shown later in FIGS. 10A and 10B are arranged on the substrate 1011 and wired in a matrix form using the row-directional wirings 1013 and the column-directional wirings 1014. In intersection portions of the row-directional wirings 1013 and the column-directional wirings 1014, insulating layers (not shown) are formed to keep the electrical insulation.

Figure 18:
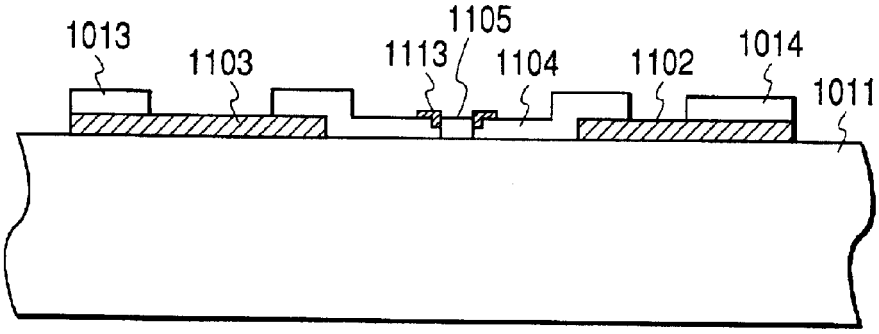
FIG. 18 is a cross sectional view showing a portion of the substrate of the multi-electron beam source.
Figure 19:
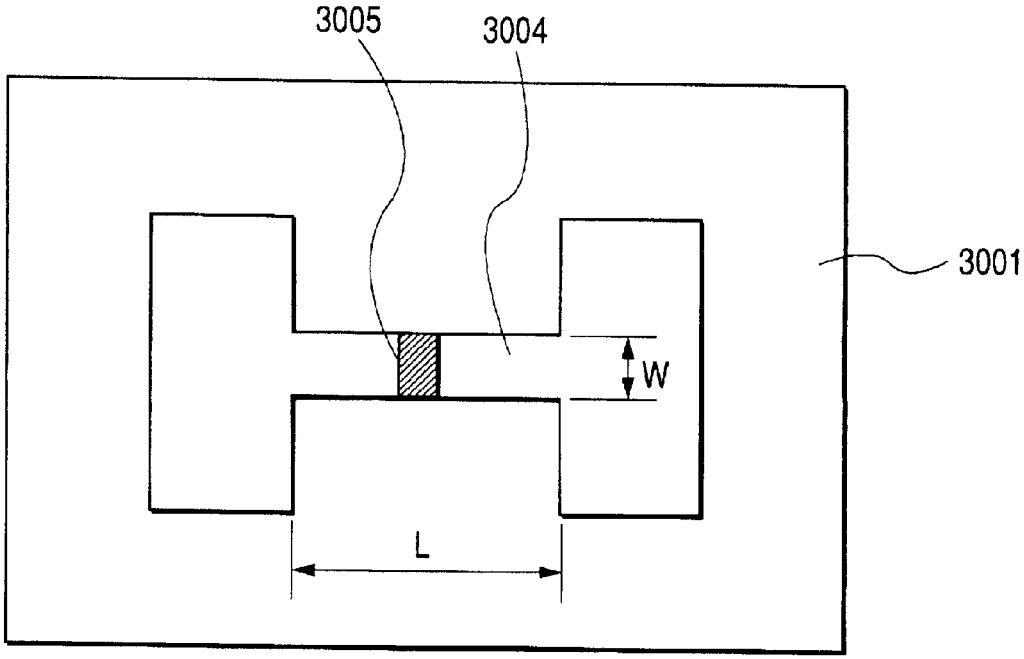
FIG. 19 is a schematic view showing one example of a conventional surface conduction type emitting device.
Figure 20:
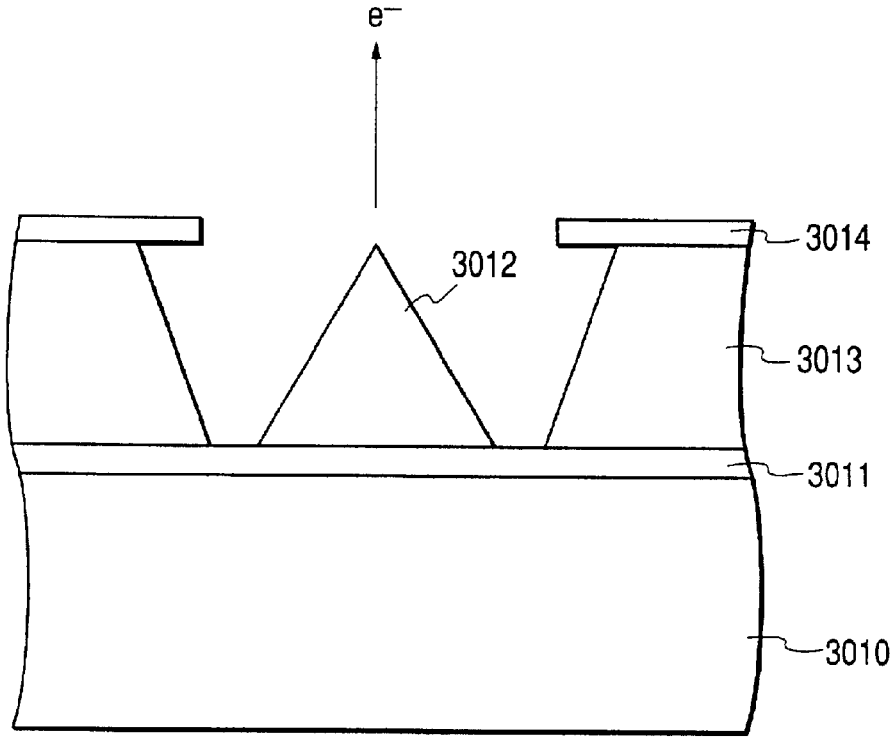
FIG. 20 is a schematic view showing one example of a conventional FE type device.
Figure 21:
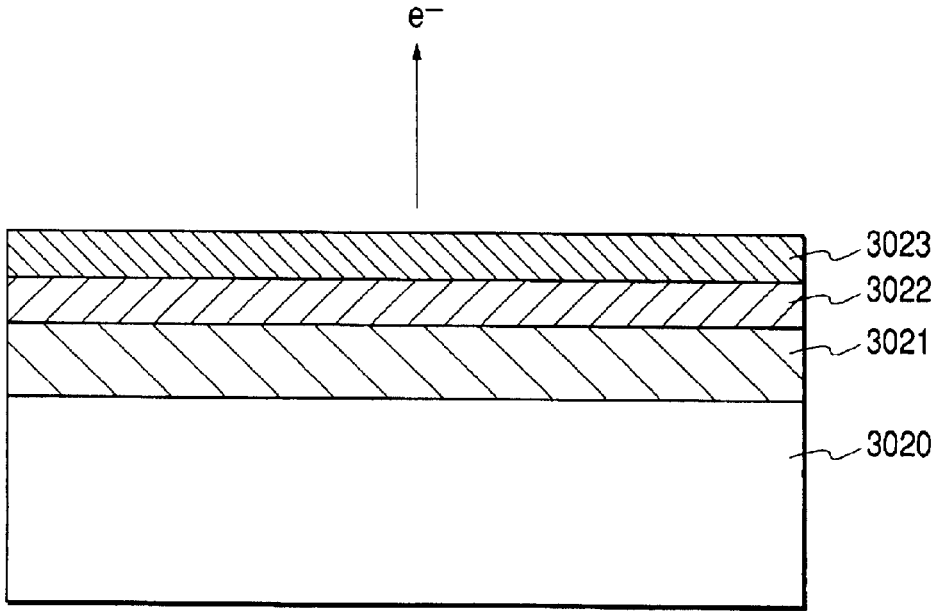
FIG. 21 is a schematic view showing one example of a conventional MIM type device.
Figure 22:
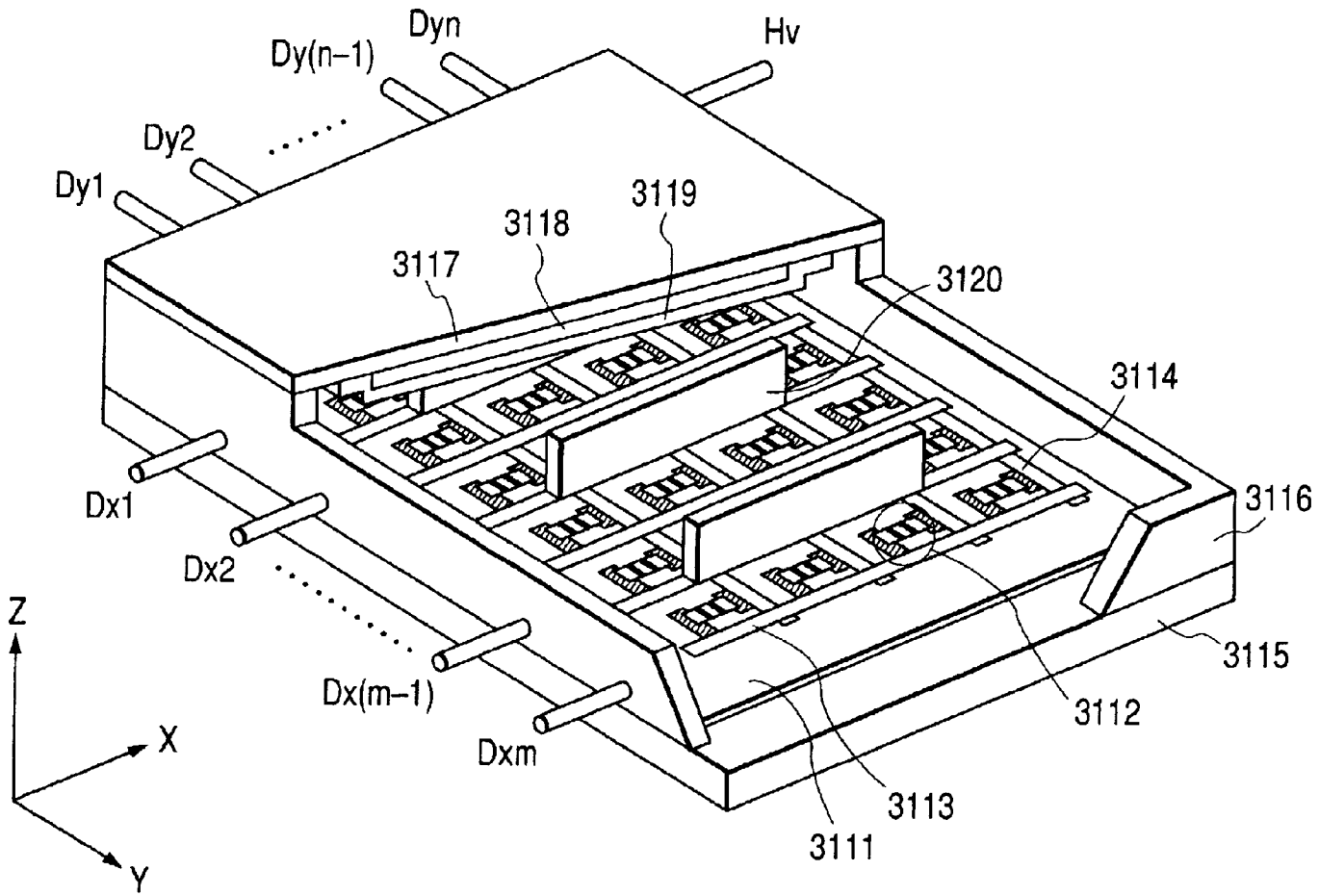
FIG. 22 is a perspective view showing a state that a portion of a display panel of the image display apparatus is cut.

A cross section taken along a dashed line B–B' in FIG. 17 is shown in FIG. 18. In this embodiment, the structure is used that the electron source substrate 101 is fixed onto the rear plate 1015. However, when the electron source substrate 1011 has an sufficient strength, the electron source substrate 1011 itself may be used as the rear plate of the airtight container.

The fluorescent film 1018 is formed on an undersurface of the face plate 1017.

Since this embodiment relates to a color display apparatus, phosphors with three primary colors (red (R), green (G), and blue (B)) are applied to the fluorescent film 1018. The phosphors with respective colors are applied in a stripe form, for example, as shown on FIG. 8A. Light shielding members 1010 are provided between the respective stripes of the phosphors. Here, block color electroconductive members are used as the light shielding members 1010. The light shielding members 1010 are provided for a purpose such that even if irradiation positions of electron beams are slightly shifted, display colors are not changed. Also, the light shielding members 1010 are provided for a purpose such that the reflection of external lights is prevented to suppress the reduction of display contrast. A material containing graphite is mainly used as black color conductors. However, as long as it is suitable for the above purposes, another material may be used.

Figure 8A:
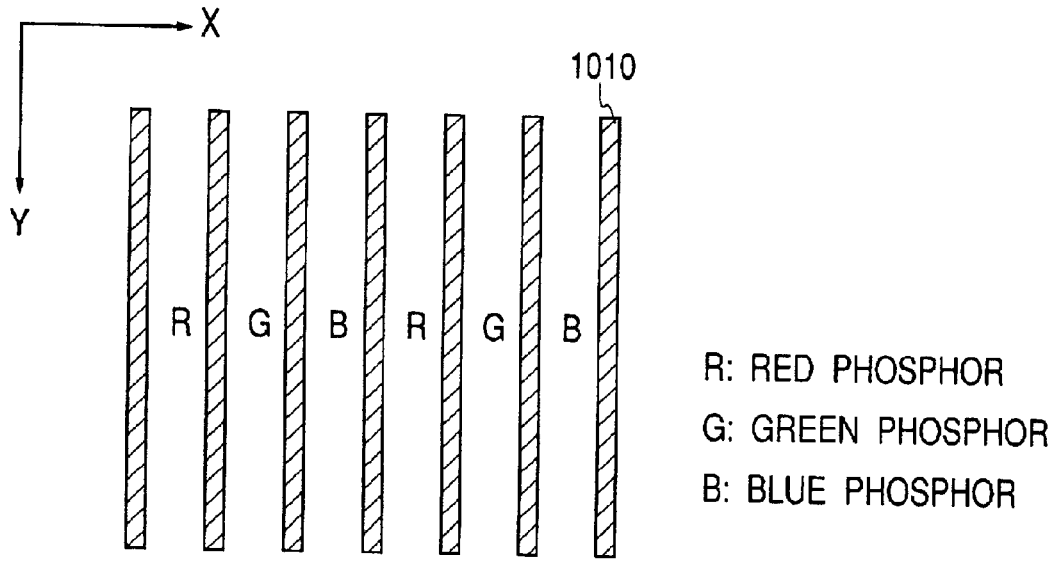
FIGS. 8A and 8B are plan views showing the arrangement of phosphors on a face plate of the display panel.
Figure 8B:
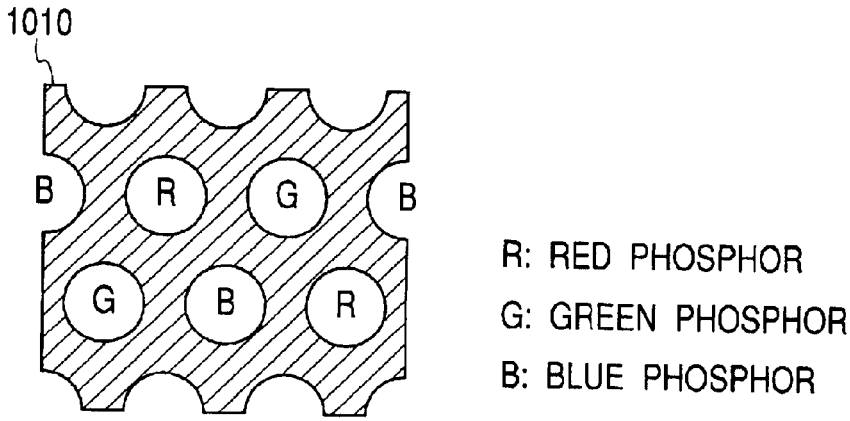
Figure 9:
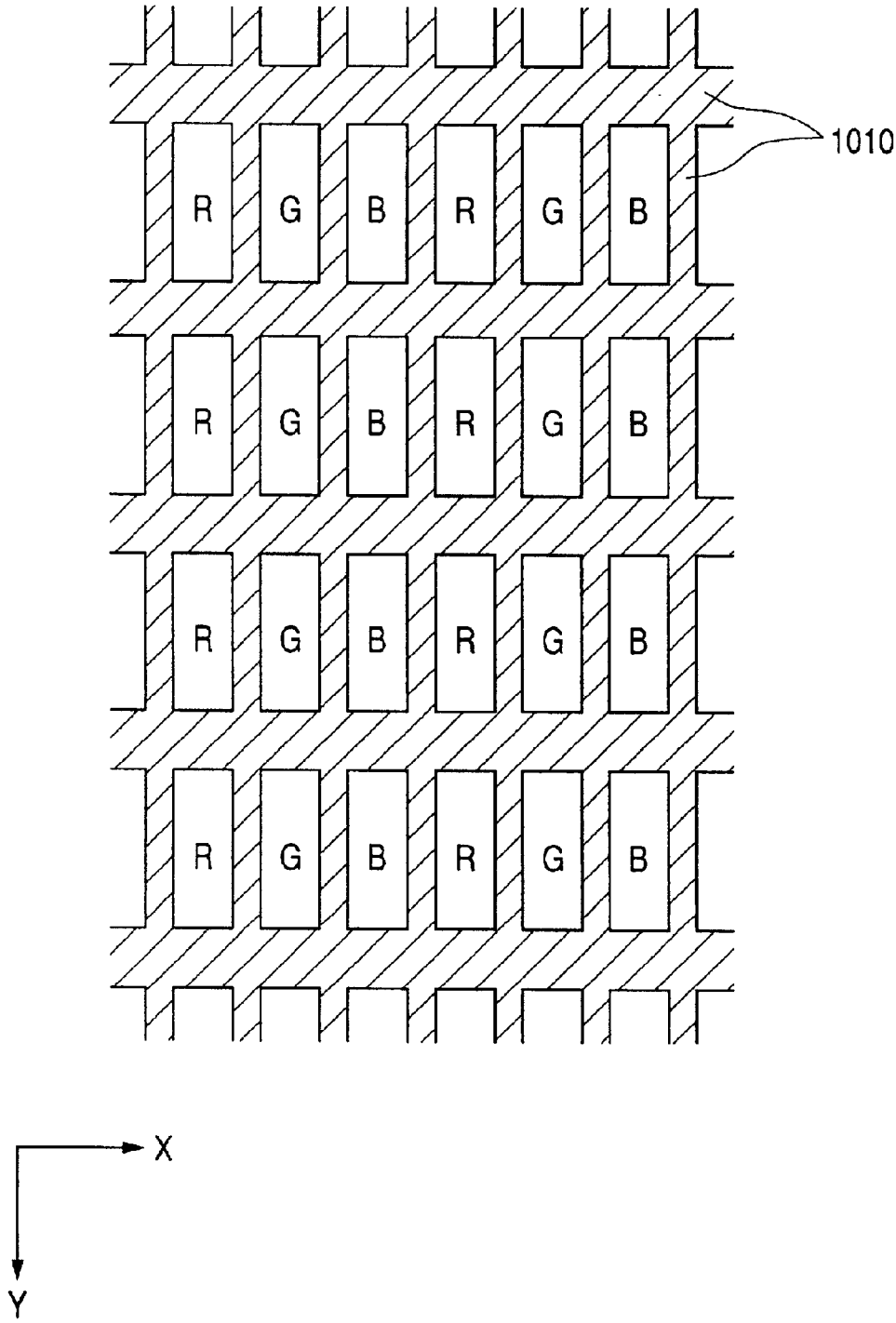
FIG. 9 is a plan view showing the arrangement of phosphors on a face plate of the display panel.

An application of the phosphors with three primary colors is not limited to the arrangement with the stripe form shown in FIG. 8A, and an arrangement with a delta form as shown in FIG. 8B or another arrangement (for example, FIG. 9) may be made.

Note that, when a monochrome display panel is manufactured, a mono color phosphor material may be used as the fluorescent film 1018. Also, the light shielding members may not be necessarily used.

The metalback (electroconductive film) 1019 which is known in a field of a CRT is provided on the surface of the fluorescent film 3118, which is in the side of the rear plate. The metal back 1019 is provided such that a portion of light emitted from the fluorescent film 1018 is mirror-reflected to improve a light utilization factor, such that the fluorescent film 1018 is protected from the impact of negative ions, such that the metal back 1019 functions as an electrode (anode) for applying an electron beam accelerating voltage, or such that the fluorescent film 1018 functions as a conductive path of excited electrons. The metal back 1019 is formed as follows. That is, after the fluorescent film 1018 is formed on the face plate substrate 1017, the surface of the fluorescent film 1018 is processed by smoothing, and then Al is vacuum-evaporated thereon. Note that, when a low voltage phosphor material is used for the fluorescent film 1018, the metal back 1019 is not used.

Although not used in this embodiment, in order to apply an accelerating voltage and improve the conductivity of the fluorescent film, a transparent electrode made of, for example, ITO, may be provided between the face plate substrate 1017 and the fluorescent film 1018.

Reference symbols Dx1 to Dxm, Dy1 to Dyn, and Hv denote electrical connecting terminals with an airtight structure, which are provided to electrically connect the display panel to electrical circuits (not shown).

The terminals Dx1 to Dxm are electrically connected to the row-directional wirings 1013 of the multi-electron beam source, the terminals Dy1 to Dyn are electrically connected to the column-directional wirings 1014 of the multi-electron beam source, and the terminal Hv is electrically connected to the metalback 1019 of the face plate 1017.

In order to vacuum-exhaust the inner portion of the airtight container, after the airtight container is assembled, an exhaust pipe and a vacuum pump, which are not shown, are connected thereto and then the airtight container is exhausted until an inner pressure reaches a vacuum of about $1\times10^{-5}$ Pa. After that, the exhaust pipe is closed. Note that, in order to keep the vacuum of the inner portion of the airtight container, a getter film (not shown) is formed in a predetermined position inside the airtight container immediately before or after the closing of the exhaust pipe. The getter film is formed by evaporating a getter material containing mainly, for example, Ba using a heater or a high frequency heating unit. By adsorption operation of the getter film, the inner portion of the airtight container is kept in a vacuum of about $1\times10^{-5}$ to $1\times10^{-7}$ Pa.

In the above described image display apparatus using the display panel, when voltages are applied to the respective electron-emitting devices 1012 through the container external terminals Dx1 to Dxm and Dy1 to Dyn, electrons are emitted from the respective electron-emitting devices 1012. Simultaneously, a high voltage of several hundreds volts to several kilovolts is applied to the metalback 1019 through the container external terminal Hv to accelerate the emitted electrons. Thus, the electrons are collided with the inner surface of the face plate 1017. As a result, the phosphors with respective colors, composing the fluorescent film 1018, are excited to emit light, and then the image is displayed.

Generally, the voltages applied to the surface conduction type emitting devices 1012 are about 12 to 16 V. Also, the distance between the metalback 1019 and the electron-emitting devices 1012 is about 0.1 mm to 8 mm. Further, a voltage between the metalback 1019 and the electron-emitting devices 1012 is about 0.1 kV to 10 kV.

As described above, the basic structure and the manufacturing method of the display panel according to the embodiment of the present invention, and summary of the image display apparatus have been described.

(2) Method of Manufacturing Multi-Electron Beam Source

Next, a method of manufacturing a multi-electron beam source used in the display panel of the above embodiment will be described. With respect to the multi-electron beam source used in the image display apparatus of the present invention, a material, a shape, or a manufacturing method of the cold cathode electron-emitting device is not specifically limited. Therefore, the cold cathode electron-emitting device such as a surface conduction type emitting device, an FE type emitting device, or an MIM type emitting device can be used.

Note that, in a condition that a display apparatus having a large display screen at a low cost is desired, of those electron-emitting devices, the surface conduction type emitting device is particularly preferable. Since the surface conduction type emitting device is manufactured by a relatively simple method, the expansion of the area and the reduction of the manufacturing cost is easily made. Thus, first, a basic structure, a manufacturing method, and a characteristic of a preferable surface conduction type emitting device will be described, and then a structure of the multi-electron beam source in which a large number of devices are wired in a passive matrix will be described.

(Preferable Device Structure and Manufacturing Method of Surface Conduction Type Emitting Device)

As a typical structure of the surface conduction type emitting device, there are two types, that is, a plane type and a step type.

(Surface Conduction Type Emitting Device of Plane Type)

First, a device structure and a manufacturing method of a surface conduction type emitting device of a plane type will be described. FIGS. 10A and 10B are a plan view (FIG. 10A) and a cross sectional view (FIG. 10B) for explaining the structure of the surface conduction type emitting device of the plane type. In the drawings, reference numeral 1101 denotes a substrate, 1102 and 1103 denote device electrodes, 1104 denotes an electroconductive thin film, 1105 denotes a gap, and 1113 denotes a carbon film formed by "the activation operation".

As the substrate 1101, for example, a glass substrate made of quartz glass, soda lime glass, or the like, a ceramic substrate made of alumina or the like, a substrate in which an insulating layer made of, for example, $SiO_2$ is laminated on the above respective substrates, or the like, can be used.

The device electrodes 1102 and 1103 are provided on the substrate 1101 opposing in parallel with the substrate surface and formed using an electroconductive material. As the electroconductive material, a material suitably selected from metal such as Ni, Cr, Au, Mo, W, Pt, Ti, Cu, Pd, or Ag, alloy of these metals, metal oxide such as $In_2O_3$-$SnO_2$, semiconductor such as polysilicon, and the like may be used. When a combination of a film formation technique such as vacuum evaporation and a patterning technique such as photolithography or etching is used, these electrodes can be easily formed. However, the electrodes may be formed using another method such as a printing technique.

Shapes of the device electrodes 1102 and 1103 are suitably designed in accordance with the application purpose of the electron-emitting device. Generally, an electrode interval L is set to be a suitable value selected from a range of several hundreds of angstroms to several hundreds of micrometers. When the electron-emitting device is applied to the display device, a range of several micrometers to several tens of micrometers is preferable.

A thickness d of the device electrodes is generally set to be a suitable value selected from a range of several hundreds of angstroms to several micrometers.

A film thickness of the electroconductive thin film 1104 is suitably set by taking various conditions described below into consideration. That is, there are a condition required for electrically and preferably connecting to the device electrode 1102 or 1103, a condition required for preferably performing "the forming process" described later, a condition required for setting the electrical resistance of the electroconductive thin film itself to a suitable value described later, and the like. Concretely, the film thickness is set within a range of several angstroms to several thousands of angstroms, and preferably, within a range of 10 angstroms to 500 angstroms.

A material used for forming the electroconductive thin film 1104 is suitably selected from metal such as Pd, Pt, Ru, Ag, Au, Ti, In, Cu, Cr, Fe, Zn, Sn, Ta, W, or Pb, oxide such as PdO, $SnO_2$, $In_2O_3$, PbO, or $Sb_2O_3$, boride such as $HfB_2$, $ZrB_2$, $LaB_6$, $CeB_6$, $YB_4$, or $GdB_4$, carbide such as TiC, ZrC, HfC, TaC, SiC, or WC, nitride such as TiN, ZrN, or HfN, semiconductor such as Si or Ge, carbon, or the like.

A sheet resistance value of the electroconductive thin film 1104 is set within a range of $10^3$ to $10^7$ ohms/square.

Note that, it is desirable that the electroconductive thin film 1104 and the device electrodes 1102 and 1103 are electrically and preferably connected with each other. Thus, a structure is used such that they are overlapped with each other in a portion. In the case of FIGS. 10A and 10B, the substrate, the device electrodes, and the electroconductive thin film are laminated in this order from the bottom. However, the substrate, the electroconductive thin film, and the device electrodes may be laminated in this order from the bottom.

The gap 1105 is formed by "the forming process" and/or "the activating process", which are described later. Note that, it is difficult to show a position and a shape of the actual gap with precision and accuracy. Thus, the gap is schematically shown in FIGS. 10A and 10B.

The thin film 1113 is one of the carbon film made of carbon or carbon compound. The thin film 1113 is formed by "the activating process" described later after "the forming process".

The thin film 1113 is single crystalline graphite, polycrystalline graphite, amorphous carbon, or these mixtures. Note that, it is difficult to show a position and a shape of the actual thin film 1113 with precision. Thus, the thin film is schematically shown in FIGS. 10A and 10B. Also, the device in which a portion of the thin film 1113 is removed is shown in the plan view (FIG. 10A).

The basic structure of the preferable device is described above. However, in this embodiment, the following device is used. That is, soda lime glass is used for the substrate 1101 and Ni thin films are used as the device electrodes 1102 and 1103. The thickness d of the device electrodes is set to be 1000 angstroms and the electrode interval L is set to be 2 micrometers.

As a main material of the electroconductive thin film 1104, Pd or PdO is used. A thickness of the electroconductive thin film is set to be about 100 angstroms. A width W is set to be 100 micrometers.

Next, a method of manufacturing the preferable surface conduction type emitting device of the plane type will be described. FIGS. 11A to 11E are cross sectional views for explaining a process for manufacturing the surface conduction type emitting device. The same members are denoted by the same reference numerals as in FIGS. 10A and 10B.

Figure 11A:
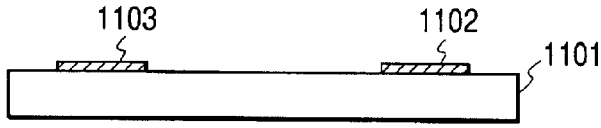
FIGS. 11A, 11B, 11C, 11D and 11E are cross sectional views showing steps of manufacturing the surface conduction type emitting device of the plane type.

1) First, as shown in FIG. 11A, the device electrodes 1102 and 1103 are formed on the substrate 1101. In this formation, after the substrate 1101 is sufficiently washed in advance using detergent, pure water, and organic solvent, a material of a device electrode is deposited thereon. (As a deposition method, a vacuum film formation technique such as an evaporation method or a sputtering method may be used.) Then, the deposited device electrode material is patterned by using a photolithography etching technique to form a pair of device electrodes 1102 and 1103 shown in FIG. 11A.

Figure 11B:
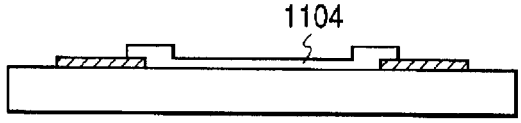

2) Next, as shown in FIG. 11B, the electroconductive thin film 1104 is formed. In this formation, first, an organic metal solution is applied onto the substrate shown in FIG. 11A and dried. Then, a firing treatment is performed to form an electroconductive thin film. After that, the electroconductive thin film is patterned with a predetermined form by photolithography etching. Here, the organic metal solution is a solution of an organic metal compound containing a material used for the electroconductive thin film as a main element. (Concretely, in this embodiment, Pd is used as the main element. Also, in this embodiment, as an applying method, a dipping method is used. However, another method such as a spinner method or a spray method may be used.) As a method of forming the electroconductive thin film, in addition to the method by applying the organic metal solution, which is used in this embodiment, there is the case where a vacuum evaporation method, a sputtering method, a chemical vapor deposition method, or the like is used.

Figure 11C:
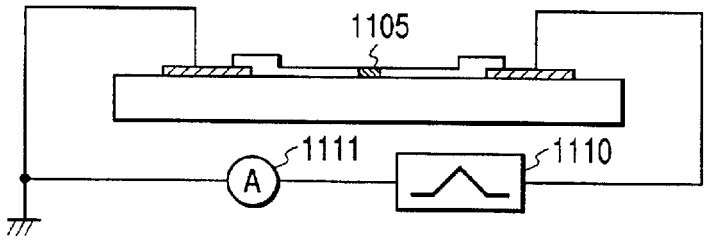

3) Next, as shown in FIG. 11C, a suitable voltage is applied between the device electrodes 1102 and 1103 from a forming power source 1110 to perform "the forming process". Thus, a gap is formed in a portion of the electroconductive thin film 1104.

"The forming process" is an operation for flowing a current into the electroconductive thin film 1104 to produce a gap in a portion thereof. Note that, an electrical resistance measured between the device electrodes 1102 and 1103 after the formation of the gap is greatly increased in comparison with the electrical resistance before the formation of the gap.

Figure 12:
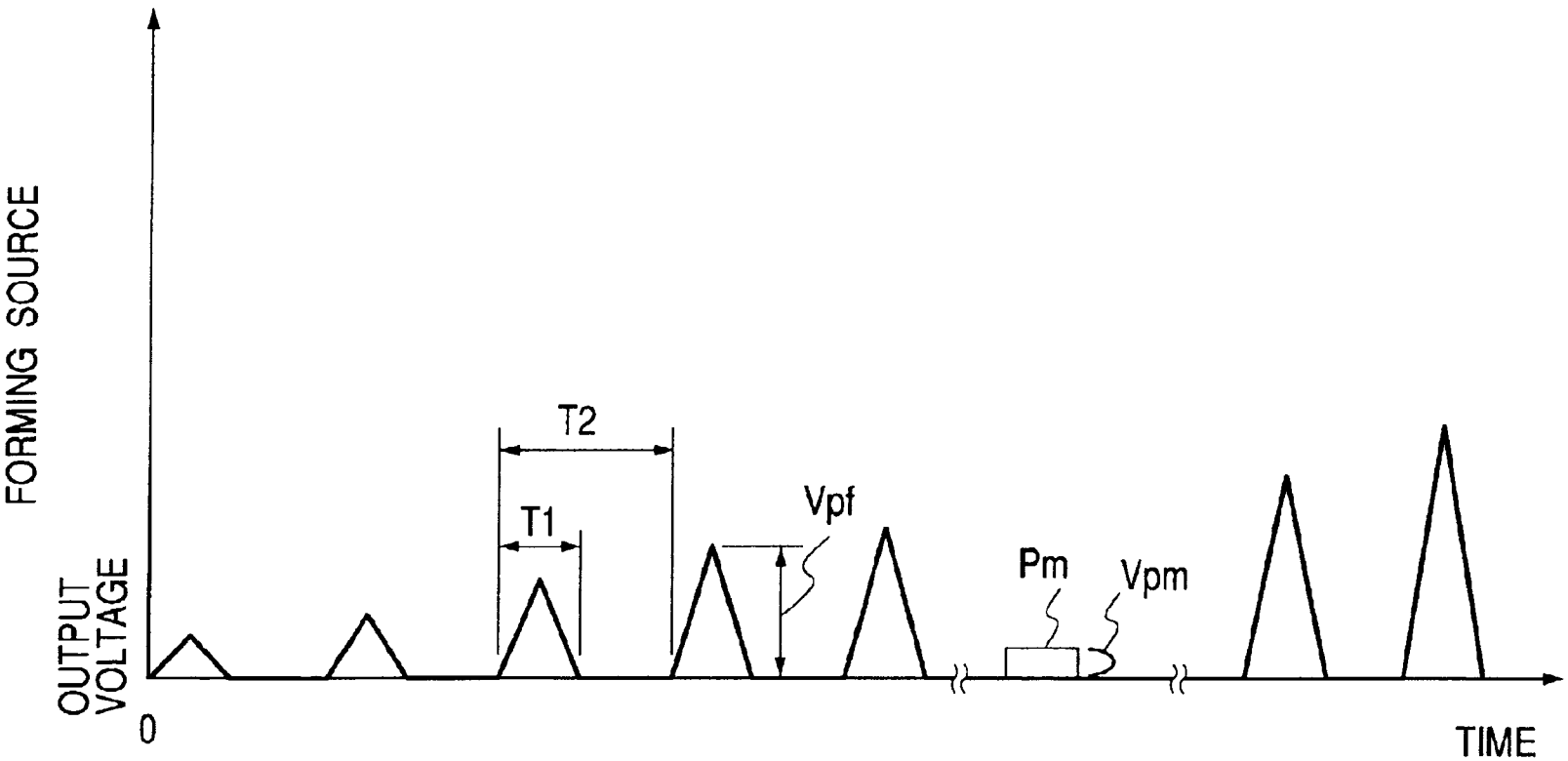
FIG. 12 is an applied voltage waveform diagram at energization forming operation.

In order to describe an energization method in detail, one example of a waveform of a suitable voltage applied from the forming power source 1110 is shown in FIG. 12. In the case where the forming process is performed for the electroconductive thin film, a pulse voltage is preferable. In this embodiment, as shown in FIG. 12, a triangular wave pulse with a pulse width Ti is continuously applied at a pulse interval T2. At this time, a pulse height value Vpf of the triangular wave pulse is risen stepwise. Also, a monitor pulse Pm for monitoring a formation state of the gap is inserted between the triangular wave pulses at a suitable interval and a current flowing at this time is measured by a current meter 1111.

According to this embodiment, in the case of a vacuum atmosphere with, for example, about $10^{-3}$ pa, the pulse width T1 is set to be 1 millisecond and the pulse interval T2 is set to be 10 milliseconds. Also, the pulse-height value Vpf is risen by 0.1 V every one pulse. Then, one monitor pulse Pm is applied after five triangular wave pulses are applied. In order not to affect the forming operation, a voltage Vpm of the monitor pulse is set to be 0.1 V. When the electrical resistance between the device electrodes 1102 and 1103 becomes $1\times10^6$ ohms, that is, when the current measured by the current meter 1111 at the application of the monitor pulse becomes $1\times10^{-7}$ A or less, the energization relating to the forming operation is stopped.

Note that, the above method is a preferable method with respect to the surface conduction type emitting device of this embodiment. Thus, when the design of the surface conduction type emitting device, such as a material and a film thickness of the electroconductive thin film or the device electrode interval L is changed, it is desirable that an energization condition is suitably changed according to the changed design.

Figure 11D:
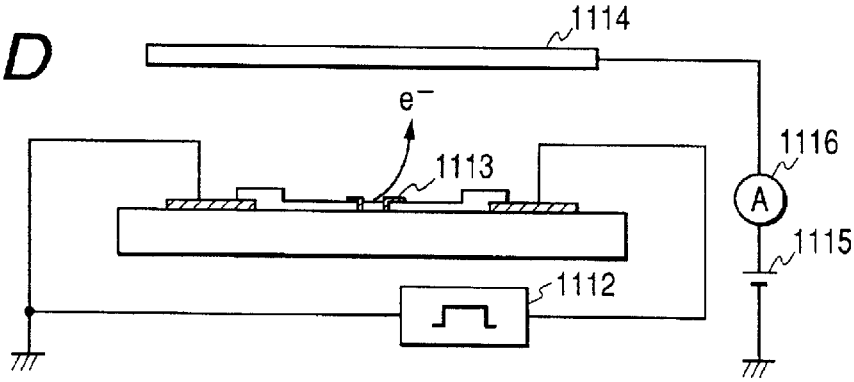

4) Next, as shown in FIG. 11D, a suitable voltage is applied between the device electrodes 1102 and 1103 by an activating power source 1112 to perform "the activating process". Thus, an electron emitting characteristic is improved. "The activating process" is an operation for depositing a carbon film made of carbon or carbon compound in the vicinity of the gap formed by the above "forming process". (In the drawing, the carbon film made of carbon or carbon compound is schematically shown as the member 1113.) Note that, an emission current in the same application voltage after "the activating process" can be typically increased by 100 times or more than the emission current before "the activating process".

Concretely, in a vacuum atmosphere with a range of $1\times10^{-2}$ to $1\times10^{-3}$ Pa or in an atmosphere into which a carbon compound gas or the like as an organic gas are introduced and which is kept in a predetermined pressure, a voltage pulse is periodically applied between the device electrodes 1102 and 1103. By this process, the carbon film 1113 made of carbon or carbon compound originated in the carbon compound present in the atmosphere is deposited. The carbon film 1113 is single crystalline graphite, polycrystalline graphite, amorphous carbon, or these mixtures.

Figure 13A:
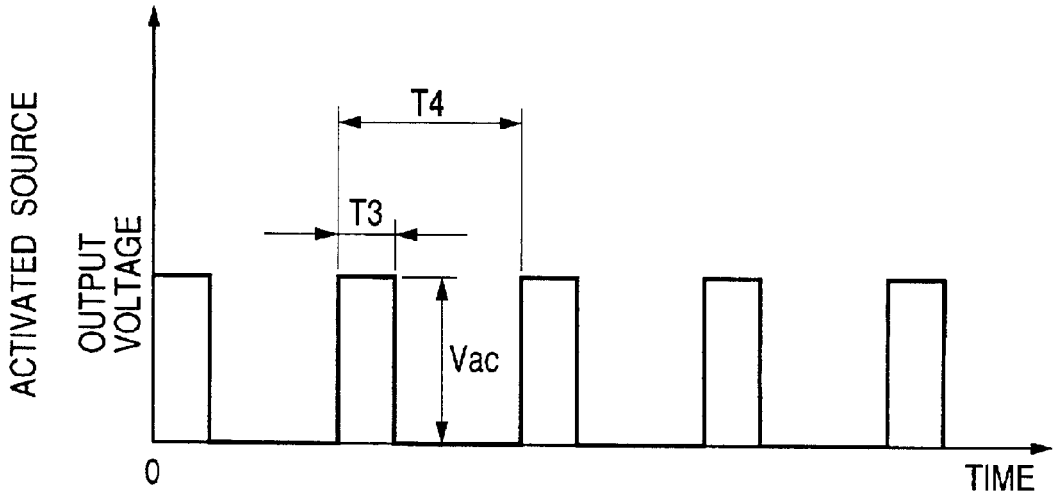
FIGS. 13A and 13B are a characteristic diagram showing an applied voltage waveform at the time of energization activation operation and a characteristic diagram indicating a change in an emission current Ie, respectively.

In order to describe an energization method in details, one example of a waveform of a suitable voltage applied from the activating power source 1112 is shown in FIG. 13A. In this embodiment, a rectangular wave with a constant voltage is periodically applied to perform "the activating process". Concretely, a voltage Vac of the rectangular wave is 14 V, a pulse width T3 is 1 millisecond, and a pulse interval T4 is 10 milliseconds. Note that, the above energization condition is a preferable condition with respect to the surface conduction type emitting device of this embodiment. Thus, when the design of the surface conduction type emitting device is changed, it is desirable that the energization condition is suitably changed in response to the changed design.

Figure 13B:
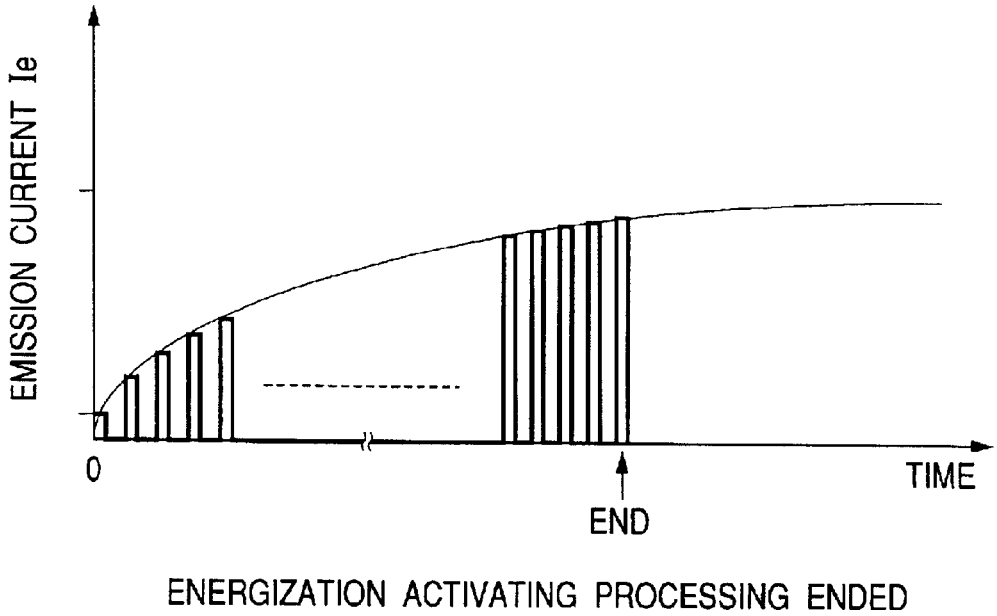

Reference numeral 1114 shown in FIG. 11D denotes an anode electrode for trapping the emission current Ie emitted from the surface conduction type emitting device. The anode electrode 1114 is connected with a direct current high voltage power source 1115 and a current meter 1116. Note that, when "the activating process" is performed after the substrate 1101 is incorporated into the display panel, a fluorescent surface of the display panel is used as the anode electrode 1114. While the voltage is applied from the activating power source 1112, the emission current Ie is measured by the current meter 1116 to monitor a progress state of "the activating process". Thus, the operation of the activating power source 1112 is controlled. One example of the emission current Ie measured by the current meter 1116 is shown in FIG. 13B. When the application of a pulse voltage from the activating power source 1112 is started, the emitting current Ie is increased with the elapse of time. However, the emitting current Ie is saturated later and thus is hardly increased. Therefore, when the emission current Ie is nearly saturated, the application of the voltage from the activating power source 1112 is stopped to end "the activating process".

Note that the above voltage application condition is a preferable condition with respect to the surface conduction type emitting device of this embodiment. Thus, when the design of the surface conduction type emitting device is changed, it is desirable that the voltage application condition is suitably changed in response to the changed design.

Figure 11E:
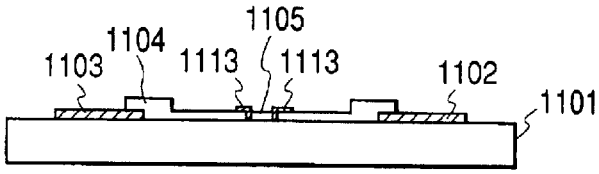

By the above processes, the surface conduction type emitting device of the plane type, as shown in FIG. 11E, is manufactured.

(Surface Conduction Type Emitting Device of Step type)

Next, a structure of a surface conduction type emitting device of a step type will be described.

Figure 14:
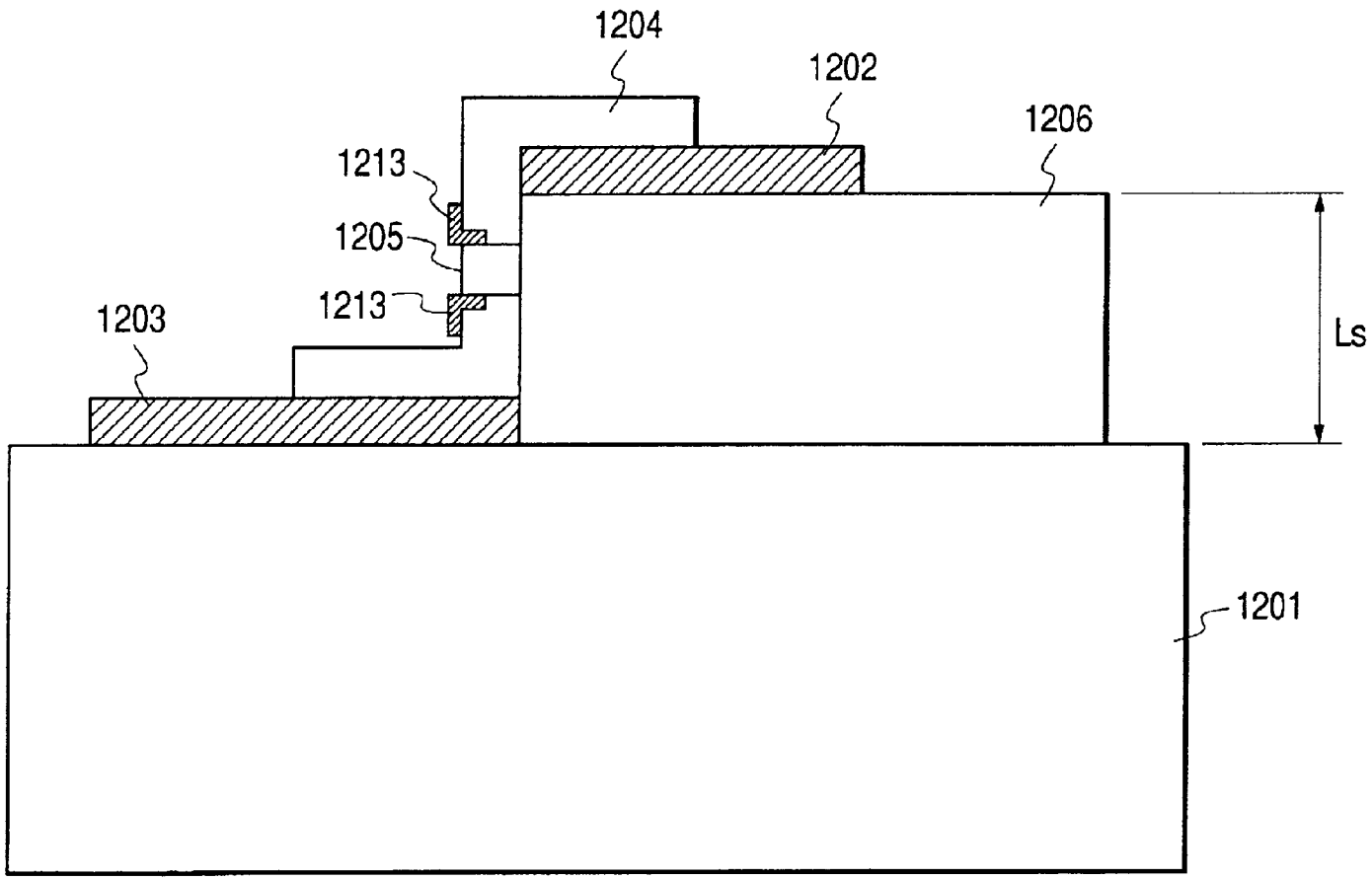
FIG. 14 is a cross sectional view of the surface conduction type emitting device of a vertical type.

FIG. 14 is a schematic cross sectional view for explaining the structure of the step type. In the drawings, reference numeral 1201 denotes a substrate, 1202 and 1203 denote device electrodes, 1206 denotes a step forming member, 1204 denotes an electroconductive thin film, 1205 denotes a gap, and 1213 denotes a carbon film formed by "the activating process".

In the step type, a point different from the plane type is as follows. That is, one device electrode 1202 is provided on the step forming member 1206 and the electroconductive thin film 1204 covers a side surface of the step forming member 1206. Thus, the device electrode interval L in the plane type shown in FIGS. 10A and 10B is set as a step height Ls of the step forming member 1206 in the step type. Note that, the substrate 1201, the device electrodes 1202 and 1203, and the electroconductive thin film 1204 can be formed using the materials listed in the description of the plane type. Also, as the step forming member 1206, an electrically insulating material such as $SiO_2$ is used.

Next, a method of manufacturing the surface conduction type emitting device of the step type will be described. FIGS. 15A to 15F are cross sectional views for explaining a manufacturing process. Respective members are referred to as the same reference numerals as in FIG. 14.

Figure 15A:
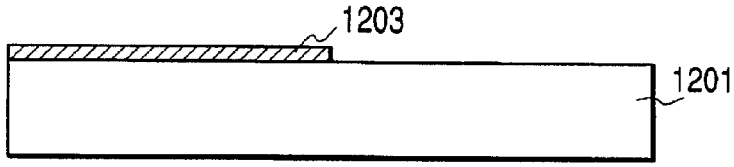
FIGS. 15A, 15B, 15C, 15D, 15E and 15F are cross sectional views showing a process for manufacturing the surface conduction type emitting device of the vertical type.

1) First, as shown in FIG. 15A, the device electrode 1203 are formed on the substrate 1201.

Figure 15B:
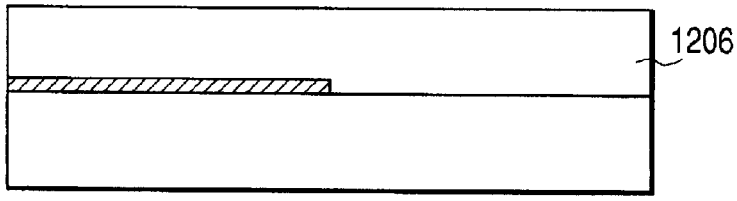

2) Next, as shown in FIG. 15B, an insulating layer for forming a step forming member is laminated on the substrate. The insulating layer may be laminated by a sputtering method using, for example, $SiO_2$. Note that, another film formation method such as a vacuum evaporation method or a printing method may be used.

Figure 15C:
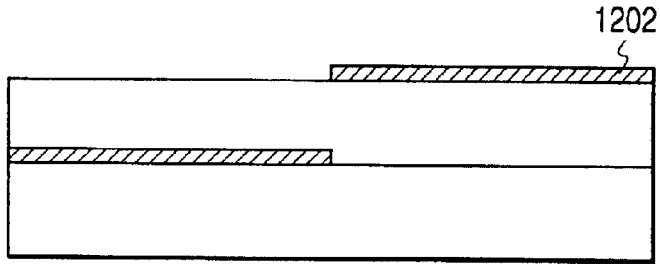

3) Next, as shown in FIG. 15C, the device electrode 1202 is formed on the insulating layer.

Figure 15D:
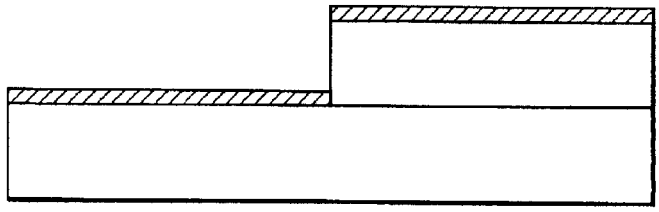

4) Next, as shown in FIG. 15D, a portion of the insulating layer is removed by, for example, an etching method to expose the device electrodes 1203.

Figure 15E:
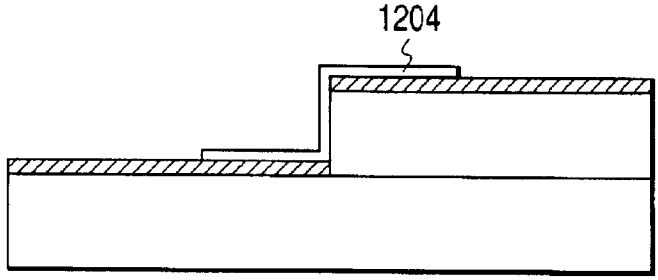

5) Next, as shown in FIG. 15E, the electroconductive thin film 1204 is formed. In this formation, as the case of the above plane type, a film formation technique such as an applying method may be used.

6) Next, "the forming process" is performed as the case of the above plane type to form the gap. Here, the same operation as the energization forming operation for the plane type, which is described using FIG. 11C, may be performed.

7) Next, "the activating process" is performed as the case of the above plane type to deposit a carbon film made of carbon or carbon compound. Here, the same operation as "the activating process" for the plane type, which is described using FIG. 11D, is performed.

Figure 15F:
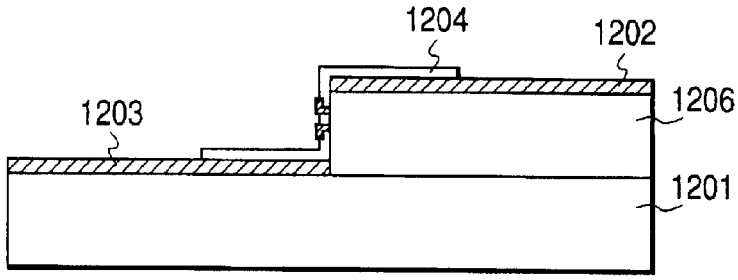

By the above processes, the surface conduction type emitting device of the step type, as shown in FIG. 15F, is manufactured.

(Characteristic of Surface Conduction Type Emitting Device Used for Display apparatus)

The device structure and the manufacturing method with respect to the surface conduction type emitting devices of the plane type and the step type have been described above. Next, a characteristic of the device used for the display apparatus will be described.

Figure 16:
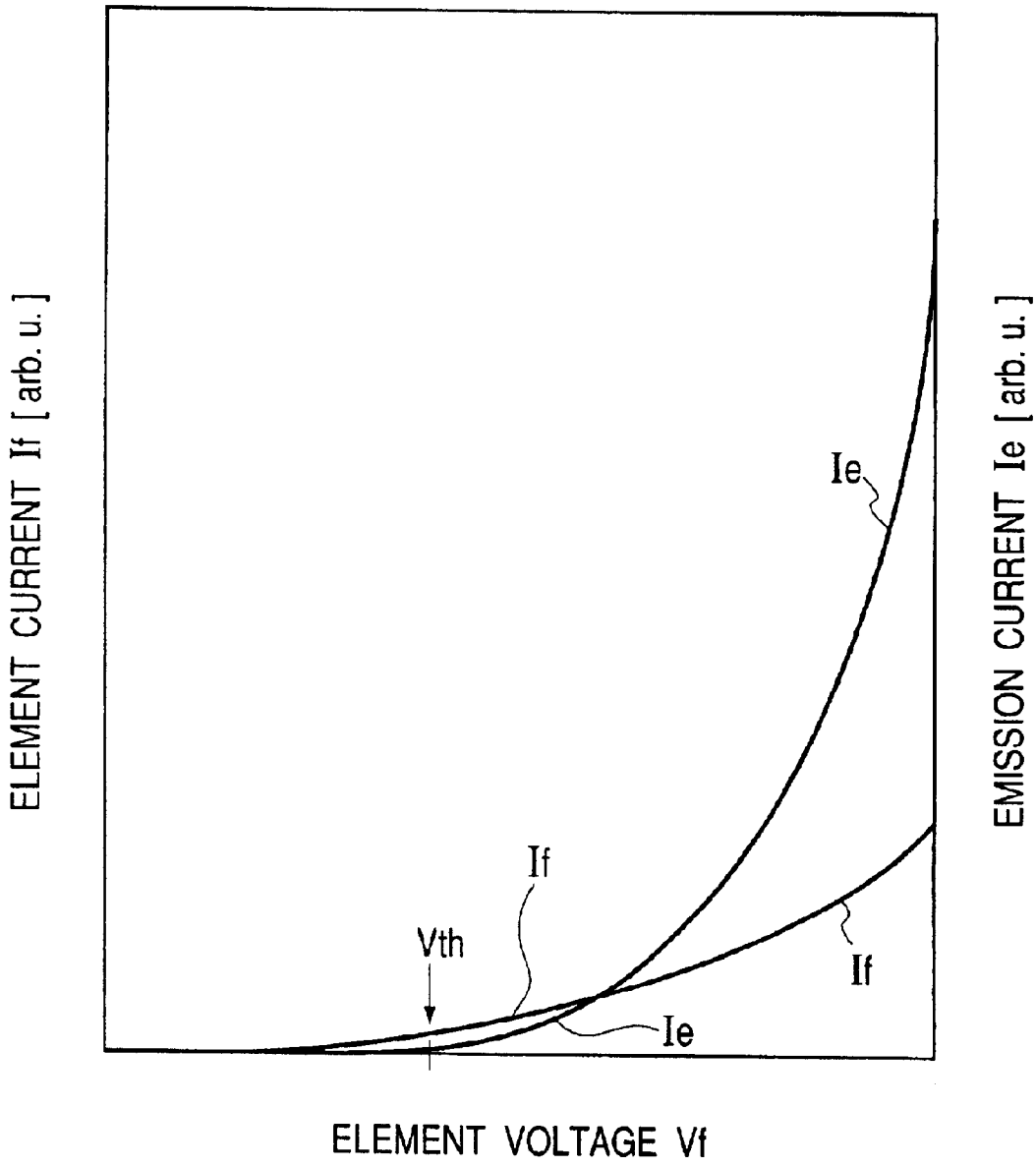
FIG. 16 is a characteristic diagram showing a typical characteristic of the surface conduction type emitting device.

FIG. 16 shows a typical example of characteristics (characteristic between the emission current Ie and an element application voltage Vf and characteristic between an element current If and the device application voltage Vf) in the device used for the display apparatus. Note that, since the emission current Ie is extremely smaller than the element current If, it is difficult to show these current values with the same scale. In addition, these characteristics are changed in accordance with design parameters such as a device size, a device shape, or the like. Thus, two graphs are shown with respective arbitrary units.

The device used for the display device has three characteristics described below with respect to the emission current Ie.

First, when a voltage (this is called a threshold voltage Vth) or higher is applied to the device, the emission current Ie is suddenly increased. On the other hand, when the a voltage lower than the threshold voltage Vth is applied to the device, the emission current Ie is hardly detected.

That is, with respect to the emission current Ie, a non-linear device having a specific threshold voltage Vth is obtained.

Second, since the emission current Ie is changed dependent on the voltage Vf applied to the device, an amount of the emission current Ie can be controlled by the voltage Vf.

Third. Since a response of the current Ie emitted from the device with respect to the voltage Vf applied to the device is quick, a charge amount of electron emitted from the device can be controlled by a period for applying the voltage Vf.

Since there are the above characteristics, the surface conduction type emitting device can be preferably used for the display apparatus. In the display apparatus in which a large number of electron-emitting devices are provided corresponding to pixels of the display screen, utilizing the first characteristic, the display can be performed by sequentially scanning the display screen (electron-emitting devices are sequentially driven every row-directional wiring). That is, a voltage equal to or higher than the threshold voltage Vth is suitably applied to the device which is driving in response to a predetermined light emitting brightness. Also, a voltage lower than the threshold voltage Vth is applied to the device which is in a non-selection state. When the device to be driven is sequentially selected, the display screen can be sequentially scanned to perform the display.

Also, since light emitting brightness can be controlled by utilizing the second characteristic or the third characteristic, a graduation sequence display can be performed.

(Structure of Multi-Electron Beam Source in which a Large Number of Devices are Wired in Passive Matrix)

Next, a structure of multi-electron beam source in which the above surface conduction type emitting devices are arranged on the substrate and wired in a passive matrix will be described.

FIG. 17 is a plan view of the multi-electron beam source used for the display panel shown in FIG. 6. The same surface conduction type emitting devices similar to structures shown in FIGS. 10A and 10B are arranged on the substrate and wired in a matrix form by using the row-directional wirings 1013 and the column-directional wirings 1014. In intersection portions of the row-directional wirings 1013 and the column-directional wirings 1014, insulating layers (not shown) are formed between the electrodes to keep the electrical insulation.

A cross section along a dashed line B–B' in FIG. 17 is shown in FIG. 18.

As described above, in the embodiment described here, the display panel is slanted such that the longitudinal direction of the plate shaped spacers arranged in the display panel is in substantially parallel with the gravitation direction. With this state, the physical impact is applied to the face plate surface or the rear plate surface. Thus, the foreign matter present in the vacuum container can be removed outside the image display region. As a result, the display image having a high quality without a pixel defect can be provided for a long time.

(Second Embodiment)

Hereinafter, with respect to an image display apparatus of the present invention, only a point different from the first embodiment will be described. According to the point different from the first embodiment, a series of processes for removing the foreign matter is performed with a negative pressure state that the inner portion of the airtight container is negatively pressurized against the outer pressure.

This purpose is to prevent the generation of new foreign matter by rubbing among the members composing the airtight container at the application of the physical impact as the foreign matter removing process by setting the inner pressure to be a negative pressure. This has a larger effect in the case where, in particular, the airtight container has spacers for resisting an atmospheric pressure. In particular, when the spacers are fixed onto one of the face plate and rear plate, the spacers slightly in contact with the other plate onto which the spacers are not fixed. Thus, this state becomes a generation source of new foreign matter by rubbing due to a vibration by the impact application. The inner pressure of the airtight container is set to be a relatively negative pressure against the outer pressure to improve the adhesion of the respective members.

As the first embodiment, the rear plate 1015, the face plate 101 as the counter electrode, the frame 102 for keeping the gap, and the spacers 103 for keeping the gap are assembled, and then the airtight container is stood as shown in FIG. 2 such as the spacers are arranged in a longitudinal direction.

Next, the inner pressure of the airtight container is set to be the negative pressure against the outer pressure. This purpose is to improve the adhesion among the face plate, the rear plate, and the spacers for keeping the gap and to prevent the generation of new foreign matter by rubbing among these parts by setting the inner pressure of the airtight container to be the negative pressure. In this embodiment, the inner pressure of the airtight container is set to be the negative pressure by the vacuum pump. However, the inner pressure may be set to be the negative pressure by a method of applying the outer pressure.

Next, as a process for floating the foreign matter, the physical impact is applied onto the face plate or the rear plate in the airtight container. The impact application method is the same one as in the first embodiment and thus omitted here. By the foreign matter removing process described here, the desorbed and removed foreign matter is present outside the image display region (in the lower portion of the panel in the slant direction). In order to prevent the return of the removed foreign matter into the image display region, it is desirable that the foreign matter pooling structure is also formed in the airtight container. According to the second embodiment, in the image display apparatus manufactured through such a process, no discharge is generated and a preferable display image in which a shadow by the foreign matter is not present can be obtained.

As described above, according to the second embodiment, the inner pressure of the airtight container is set to be the negative pressure to remove the foreign matter. Thus, the adhesion among the face plate 101, the rear plate 1015, and the spacers 103 can be improved and the generation of new foreign matter by rubbing among these parts can be prevented.

(Third Embodiment)

Hereinafter, with respect to an image display apparatus of the present invention, only a point different from the first embodiment and the second embodiment will be described. According to the point different from the first embodiment and the second embodiment, the foreign matter removing process is performed after the airtight container is sealed. That is, this process is performed in the case where the inner portion of the airtight container is in a vacuum state. According to the second embodiment, for the foreign matter removing process, the process for vacuuming the airtight container or the process for applying the outer pressure to the airtight container is performed. On the other hand, according to the third embodiment, since such a process can be omitted, it is advantage that the cost is lowered. The same effect as in the first embodiment and the second embodiment is obtained.

As described above, according to the third embodiment, the foreign matter is removed after the airtight container of the display panel is sealed. Therefore, in order to remove the foreign matter, the process for vacuuming or the process for applying the outer pressure is not required and thus the manufacturing process can be simplified.

(Fourth Embodiment)

Hereinafter, with respect to an image display apparatus of the present invention, only a point different from the first embodiment to the third embodiment will be described. According to the point different from the first embodiment to the third embodiment, as the process for floating the foreign matter, an alternating voltage is applied to the airtight container instead of the physical impact.

Figure 4:
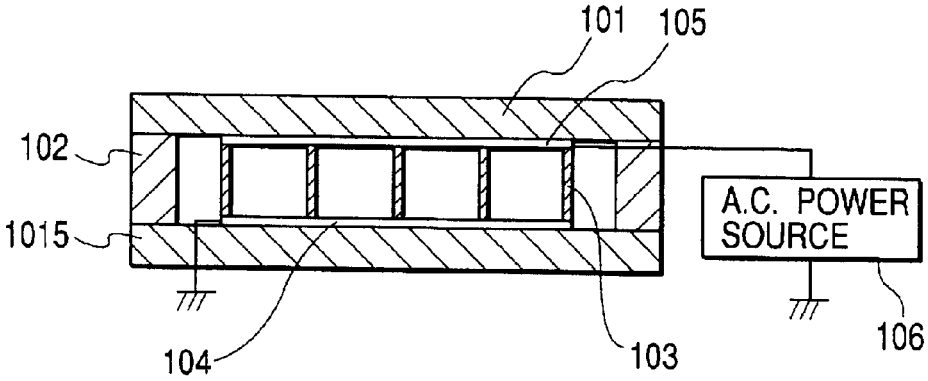
FIG. 4 is a cross sectional view of an airtight container for implementing the method of manufacturing the image display apparatus.

As shown in FIG. 4, the airtight container and an alternating power source 106 are electrically connected with each other and the voltage application is performed. With respect to wirings of the face plate and the rear plate, a high voltage side and a ground side may be reversed. When the voltage application is performed, the foreign matter present in the image region is moved to the counter electrode side while it is fallen due to the influence of the gravitation by Coulomb force due to static electricity. Since the alternating voltage is applied, a potential having a positive polarity or a negative polarity can be provided for the face plate. Then, when the potential between the face plate and the rear plate is repeatedly reversed, the foreign matter is gradually removed from the image region while it is reciprocated between the face plate and the rear plate. As a frequency of the alternating voltage at this time becomes lower, a larger number of foreign matters can be moved to the counter electrode side, and thus a larger effect is obtained. Note that, in view of the productivity, the frequency is set in a range of 0.01 Hz to 100 Hz.

In this embodiment, an alternating high voltage having a frequency of 1 Hz is gradually risen and applied to the airtight container. At this time, the inner portion of the airtight container is set to be a vacuum. Note that, when the inner portion is set to be a negative pressure against the outer pressure, a method of applying the outer pressure may be used. Also, this process may be performed after the assembly or after the sealing. When the physical impact application described in the first embodiment to the third embodiment is performed together with the above alternating voltage application, the foreign matter can be further effectively removed. In the image display apparatus manufactured thus, no discharge is generated and a preferable display image can be obtained.

As described above, according to the fourth embodiment, instead of the physical impact application, the alternating voltage application is performed. Therefore, the foreign matter present in the vacuum container can be moved outside the image region. Thus, a discharge resisting voltage can be improved and the image display apparatus in which the image in that a display image defect due to the foreign matter is not present and that has high quality can be provided can be manufactured.

(Fifth Embodiment)

Hereinafter, with respect to an image display apparatus of the present invention, only a point different from the first embodiment will be described. According to the point different from the first embodiment, a foreign matter moving process is performed. In the first embodiment, the foreign matter floated by the physical impact is moved by the gravitation. However, in this embodiment, the foreign matter is moved by air flow.

Figure 5:
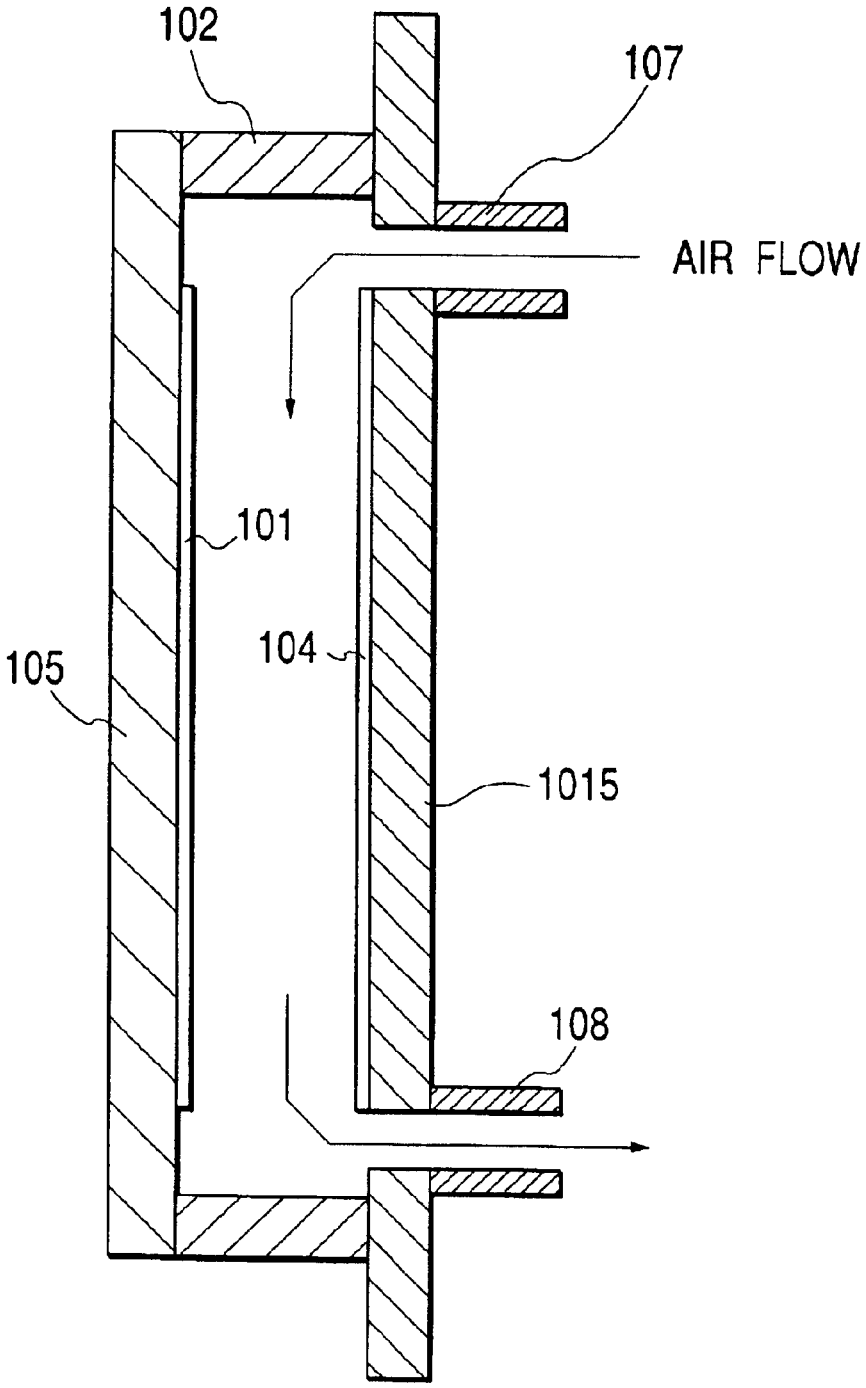
FIG. 5 is a cross sectional view of an airtight container showing a gas flow for implementing the method of manufacturing the image display apparatus.

FIG. 5 shows a schematic structure of this embodiment. A gas supply pipe 107 and an exhaust pipe 108 are provided in the airtight container. A dry nitrogen gas in which a gas pressure is in a viscosity flow region is introduced. At this time, the inner portion of the airtight container is made to be a negative pressure state against the outer pressure. Concretely, the inner pressure is set to be $1\times10^4$ Pa or higher as the viscosity flow region. By keeping this state, a process for applying the physical impact is performed.

Other processes are performed as in the first embodiment. However, in order to move the foreign matter with higher efficiency, when the self weight falling of the foreign matter due to the gravitation described in the first embodiment is made together with the gas flow, it is further effective. Also, the alternating voltage application as the process for floating the foreign matter described in the third embodiment may be performed together with the gas flow.

The introduction gas is suitably selected from, in addition to nitrogen, helium, neon, argon, hydrogen, oxygen, carbon dioxide, air, and the like. Also, it is effective to use electrostatic air by an ionizer. In the thus manufactured image display apparatus, a preferable display image without discharge can be obtained.

As described above, according to the fifth embodiment, since the foreign matter is moved by the gas flow, the foreign matter can be removed without the influence of the disposing state of the display panel.

(Sixth Embodiment)

In this embodiment, the foreign matter removing process is performed after the sealing of the airtight container. Hereinafter, a summary of processes for manufacturing the display panel in this embodiment is shown using FIGS. 2, 6, 8A, 8B, and 11A to 11E.

First, the pair of electrodes 1102 and 1103 composing the respective electron-emitting devices 1012 are formed on the rear plate 1015 (FIG. 11A).

Next, the row-directional wirings 1013 and the column-directional wirings 1014 are formed by a printing method so as to connect to the respective electrodes 1102 and 1103. Note that, in the intersection portions of the row-directional wirings 1013 and the column-directional wirings 1014, insulating layers are located.

Then, the electroconductive thin film 1104 made of PdO is located so as to make the connection between the respective electrodes 1102 and 1103 (FIG. 11B).

Next, the rear plate 1015 is located in a vacuum chamber, the inner portion of the vacuum chamber is depressurized until $10^{-3}$ Pa, and then "the forming process" described above is performed. In "the forming process", pulse voltages are applied to the respective electroconductive thin films 1104 through the row-directional wirings 1013 and the column-directional wirings 1014. By this process, the gaps 1105 are formed in respective electroconductive thin films 1104 (FIG. 11C).

Next, tolunitrile is introduced into the chamber until $10^{-4}$ Pa and then "the activation process" is performed. In "the activation process", pulse voltages are applied to the respective electroconductive thin films 1104 through the row-directional wirings 1013 and the column-directional wirings 1014. Here, the pulse voltages having both polarities are used. In this process, the carbon film 1113 is formed in the gap 1105 and on the electroconductive thin film 1104 near the gap (FIG. 11D). By the above processes, the rear plate is formed.

In contrast to the process of forming the rear plate, the face plate 101 is formed. First, in the face plate 101, the fluorescent film 1018 is formed on the glass substrate 1017. The phosphors with three primary colors (red (R), green (G), and blue (B)) and the light shielding members 1010 of black color, which is present between the phosphors with respective colors are located on the glass substrate by a screen printing method to form the fluorescent film (FIG. 8A). Next, the electroconductive film (metalback) 1019 made of aluminum is formed on the fluorescent film 1018. By the above processes, the face plate 101 is formed.

Next, the rear plate 1015, the face plate 101, which are formed by the above processes, the support frame 1016, and a plurality of the plate-shaped spacers 1020 are arranged and seal-bonded in a vacuum to form the airtight container (display panel), longitudinal directions of the spacers 1020 are substantially parallel to each other.

Next, the foreign matter removing process is performed. In this embodiment, first, as shown in FIG. 2, the airtight container is slanted such that the longitudinal direction of the plate-shaped spacers 1014 is substantially parallel with the gravitational direction. Then, the electric field lower than that applied at the time of the drive of the display panel is applied between the face plate and the rear plate. In concrete, the above described electric field is applied between a metal back of the face plate and the wirings 1013 and 1014 of the rear plate. The row and column wirings 1013 and 1014 are desirably at the same potential. Accordingly, according to the present embodiment, the row and column wirings 1013 and 1014 are set of a ground (0 V).

With respect to the above slant, it is most preferable that the airtight container is disposed (slant) such that the longitudinal direction of the plate-shaped spacers 1020 is substantially parallel with the gravitational direction. Note that, the airtight container may be disposed such that the longitudinal direction of the plate-shaped spacers 1014 is not in vertical to the gravitational direction.

In the foreign matter removing process, it is preferable that the strength of the electric field applied between the face plate (metalback) and the rear plate (row-directional wirings and/or column-directional wirings) is 1/50 to 1/2 of the electric field applied between the face plate and the rear plate at the time of the drive of the display panel (image display apparatus). This is because, if the electric field similar to that at the time of the drive of the display panel (image display apparatus) is abruptly applied, the possibility that the discharge is generated is high.

In the foreign matter removing process described here, concretely, the application voltage of the metalback 1019 is set to be 2 kV and the application voltage of the row-directional wirings and the column-directional wirings, which are arranged on the rear plate is set to be all 0 V.

When the display panel formed by the above processes is connected to driver circuits and then the voltage of 10 kV is applied to the metalback to display an image, the display image in which a pixel defect is not present and has high uniformity is stably obtained over a long period of time.

According to the present invention, a method of manufacturing an image display apparatus, in which the yield can be improved, the generation of discharge at the image display can be prevented without damaging the fluorescent surface and the electron-emitting device, and a preferable display image can be obtained, and the image display apparatus manufactured by this manufacturing method can be provided.

What is claimed is:

1. A method of manufacturing an image display apparatus, said method comprising the steps of:

providing a depressurized airtight container, wherein said airtight container comprises a rear plate having a plurality of electron-emitting devices, a face plate opposing the rear plate and having a phosphor and an electroconductive film and a plurality of plate-shaped spacers between the rear plate and the face plate; and applying an electric field between the rear plate and the face plate while the depressurized airtight container is arranged so that a longitudinal direction of the plate-shaped spacers is not perpendicular to a gravitational direction.

2. A method of manufacturing an image display apparatus according to claim 1, wherein the electric field is lower than an electric field applied between the rear plate and the face plate when driving the image display apparatus.

3. A method of manufacturing an image display apparatus according to claim 2, wherein the electric field is 1/10 to 1/2 of an electric field applied between the rear plate and the face plate when driving the image display apparatus.

* * * * *

UNITED STATES PATENT AND TRADEMARK OFFICE

CERTIFICATE OF CORRECTION

PATENT NO. : 6,840,832 B2
DATED : January 11, 2005
INVENTOR(S) : Norihiro Suzuki et al.

It is certified that error appears in the above-identified patent and that said Letters Patent is hereby corrected as shown below:

Column 1,
Line 46, “and” should be deleted.

Column 2,
Line 50, “to cause.” should read -- from being caused. --.

Column 13,
Line 37, “film” (second occurrence) should read -- films --.

Column 14,
Line 43, “width Ti” should read -- width T1 --.

Column 16,
Line 31, “electrode 1203” should read -- electrodes 1203 --.

Column 17,
Line 24, “Third. Since” should read -- Third, since --.
Line 26, “electron” should read -- electrons --.

Column 19,
Line 15, “advantage” should read -- advantageous --.

Signed and Sealed this

Fourteenth Day of March, 2006

JON W. DUDAS
*Director of the United States Patent and Trademark Office*